US008383993B2

(12) United States Patent
Kim et al.

(10) Patent No.: US 8,383,993 B2
(45) Date of Patent: Feb. 26, 2013

(54) TEMPERATURE CONTROL DEVICE OF ELECTRIC HEATER USING THERMO-SENSITIVE RESIN AND SAFETY DEVICE THEREOF

(75) Inventors: Min-Ja Kim, Gyeonggi-do (KR); Byung-Dong Kim, Daegu (KR); Chang-kyu Moon, Daegu (KR); Jung-Moo Kim, Gyeonggi-do (KR)

(73) Assignee: Bokuk Electronics, Daegu (KR)

( * ) Notice: Subject to any disclaimer, the term of this patent is extended or adjusted under 35 U.S.C. 154(b) by 562 days.

(21) Appl. No.: 12/621,940

(22) Filed: Nov. 19, 2009

(65) Prior Publication Data

US 2010/0193503 A1 Aug. 5, 2010

(30) Foreign Application Priority Data

Feb. 2, 2009 (KR) ..... 10-2009-0008106
Mar. 6, 2009 (KR) ..... 20-2009-0002553 U
Jun. 4, 2009 (KR) ..... 10-2009-0049526

(51) Int. Cl.
*H05B 1/02* (2006.01)

(52) U.S. Cl. ..... 219/494; 219/448.14; 219/481; 219/501; 219/505

(58) Field of Classification Search ..... 219/494, 219/505, 501, 481, 448.14
See application file for complete search history.

(56) References Cited

U.S. PATENT DOCUMENTS 7,241,979 B2 * 7/2007 Kil ..... 219/505
2006/0219701 A1 * 10/2006 Kil ..... 219/501

FOREIGN PATENT DOCUMENTS

KR 1999012089 2/1999
KR 10-2003-0075447 9/2003
KR 10-2008-0013685 2/2008
KR 20080098258 11/2008

OTHER PUBLICATIONS

Korean Office Action dated Aug. 18, 2010 received in corresponding priority Application No. KR 20-2009-0002553.

* cited by examiner

*Primary Examiner* — Toan Le
(74) *Attorney, Agent, or Firm* — Grossman Tucker Perreault & Pfleger, PLLC

(57) ABSTRACT

A temperature control device is disclosed that includes a heating wire being connected to an alternating current power source though a SCR, a sensing wire being disposed parallel to the heating wire, a thermo-sensitive resin insulating the heating wire and the sensing wire from each other and changing its impedance according to a change in temperature, and a temperature sensing unit outputting a temperature control signal to turn the SCR on or off according to a change in electric current flowing through the thermo-sensitive resin, in which the SCR is turned on or off by a sensing unit diode. The heating wire is heated by a heating current that flows in a heating cycle only, in which a forward voltage is formed in the SCR, and the sensing wire conducts a sensing current that flows in a sensing cycle only, in which a reverse voltage is formed in the SCR.

18 Claims, 14 Drawing Sheets

TEMPERATURE CONTROL DEVICE OF ELECTRIC HEATER USING THERMO-SENSITIVE RESIN AND SAFETY DEVICE THEREOF

CROSS-REFERENCE TO RELATED APPLICATIONS

This application claims the benefit of Korean Patent Application Nos. 10-2009-0008106, 10-2009-0049526, 20-2009-0002553, filed with the Korean Intellectual Property Office on Feb. 2, 2009, Jun. 4, 2009 and Mar. 6, 2009, respectively, the disclosure of which is incorporated herein by reference in their entirety.

BACKGROUND

1. Technical Field

The present invention relates to a sensing wire-type temperature control device and a safety device for the sensing wire-type temperature control device, in connection with a heating cable, which is commonly used in a heating apparatus, e.g., an electric heater such as an electric blanket and an electric mattress pad, controlling the temperature by sensing a change in temperature by use of a sensing wire and being insulated with a thermo-sensitive resin that changes its impedance in accordance with the change in temperature between an electric heating body and the sensing wire.

The present invention also relates to a temperature control device using a thermo-sensitive insulation resin of an electric heater that can reduce a magnetic field generated by an electric heating body, through which electric currents flow in opposite directions.

2. Description of the Related Art

To control the temperature of an electric heater, two methods are commonly used. One is a thermometer method in which a temperature sensor is installed in the electric heater to control the temperature of the electric heater, which is heated by an electric current flowing through its heating wire, so that the change in temperature can be detected and controlled. The other is a sensing wire method in which a thermo-sensitive insulation resin is used to detect and control the change in electric current flowing through its sensing wire by using the impedance of a nylon thermistor, which is an insulation covering.

As illustrated in FIG. 1, an electric heating cable according to the sensing wire method using thermo-sensitive insulation resin may include a heating wire insulated by a nylon thermistor (NTC), which changes its impedance in accordance with the temperature of the heating wire, a sensing wire, which is wound on the nylon thermistor, and an exterior insulation covering, which covers the sensing wire.

In the sensing wire method using the thermo-sensitive insulation resin, the heating wire produces heat when an electric current flows through the heating wire, and the sensing wire controls the temperature of the electric heating cable by sensing the change in electric current that is caused by the changing impedance of the thermo-sensitive resin, which is changed in accordance with the temperature of the heating wire.

Compared to the method of using a separate temperature sensor and a bi-metal, which is for preventing overheating, the sensing wire method using the thermo-sensitive insulation resin is widely used because it uses a typical heating wire and the thermosensitive wire itself can not only sense a change in temperature but also prevent overheating, thereby facilitating easier installation and lowering the manufacturing costs.

Furthermore, since the sensing wire is wound on the heating wire from one end to the other, its ability to prevent local overheating is much more reliable than the thermometer method using a typical temperature sensor.

For example, in the case of an electric mat, if the electric mat is folded or a heavy object, for example, a pillow, is placed on the electric mat, the thermometer method, which generally uses two temperature sensors and two bi-metals for a typical electric mat for two persons would not accurately sense the change in temperature if the portion that is partially folded or loaded with the heavy object is too far away from the temperature sensors and the bi-metals.

Consequently, the folded portion may be overheated compared to the unfolded portions because its temperature is not sensed by the temperature sensors.

Installing more temperature sensors in the electric mat may increase the reliability of sensing the overheating but would be practically impossible due to the working conditions or manufacturing costs.

Compared to the thermometer method, the sensing wire method using the thermo-sensitive insulation resin can sense the change in temperature even if a certain portion is folded or pressed, because the sensing wire is installed throughout the heating wire. Thus, overheating can be prevented from occurring despite a local overheating.

Nevertheless, the sensing wire method is unable to detect local overheating completely with the 100 percent accuracy. As a result, there have been complaints raised by the users every year due to accidents, for example, fires and burns, caused by the local overheating.

This is because the electric currents show different values for different overheating areas although the temperature rise is the same, due to different voltages caused by voltage drop at different locations of the sensing wire using a nylon thermistor.

Therefore, temperature may be detected differently at different locations of the heating wire, causing a burn to the user, causing a fire or shortening the product life.

Moreover, in case local overheating occurs at an area near the ground, sensing currents may not be sufficient enough to generate a signal to cut off the power supply despite the continuous increase in temperature. Consequently, the heating cable can reach dangerous temperatures to cause a burn or fire.

In the case of electric mats and electric floor mats, the heating wire is typically installed in the method illustrated in FIG. 2. However, if the temperature control device is unable to accurately detect an increase in temperature at different locations, as described above, the temperature may or may not be properly controlled depending on the location where the user lies and may cause overheating.

Even though the temperature control device is preset by the user at a desirable temperature, the temperature of the heating cable may be rise or drop depending on the location where the user lies. As a result, the user may have to turn the dial up or down to maintain the desirable temperature, causing inconvenience to the user.

Also, if a defect occurs in some parts of the temperature control device (especially if a power control component (SCR) malfunctions so that electrical conduction is formed, or if the change in temperature is detected inaccurately because of a short-circuit in the sensing wire), the accidents described above may occur.

Therefore, a minimal safety measure is inevitably needed.

Recently, as it has become known that a magnetic field may be harmful to humans, the development of a sensing wire that can block a harmful magnetic field is currently under way. KR Patent Publication No. 1999-012089 discloses a way of blocking a harmful magnetic field. In FIG. 1 of this example, two heating wires are combined to form a double structure, and a terminal unit is electrically connected to the double structure. When power is supplied to the heating wires, the electric currents flowing through the two parallel heating wires flow in opposite directions, and thus a magnetic field formed between the two heating wires can be offset by the two opposite flowing currents.

In this type of heating wires for blocking a magnetic field, the two heating wires may be closely positioned by interposing an insulation material in between them, or a PVC or silicon covering may be formed around one heating wire, and then another heating wire may be wound on the heating wire so as to block the magnetic field.

Although such methods described above may block the harmful magnetic field, a heating current still flows through the sensing wire so that the sensing wire may be unable to detect a minute change in electric current according to the change in impedance of the thermo-sensitive insulation resin.

Therefore, the sensing wire method using the thermo-sensitive insulation resin may not be used alone, and an additional temperature controlling method must be employed. As a result, the manufacturing costs, the manufacturing process and the manufacturing time may be increased.

The technology shown in FIG. 3 is a heating wire structure that can block a magnetic field, and was disclosed by the inventor of this application to complement those disadvantages described above in KR Patent No. 10-0871682.

The technology shown in FIG. 2 is a triple-structured electric heating cable, in which a first wire, i.e., the main wire, is used as a heating wire and then insulated with a nylon thermo-sensitive resin, i.e., the insulation covering. After the nylon thermo-sensitive resin is formed around the first wire, a second wire, i.e., the temperature sensing wire, is wound on the nylon thermo-sensitive resin.

Afterwards, a PVC covering is formed around the outer surface of the temperature sensing wire, and then a third wire, i.e., the heating wire, is wound on the PVC covering. Therefore, the first wire and the third wire are electrically connected to each other.

In this structure, when power is supplied to the first wire and the third wire, the electric currents flowing in the first and third wires flow in opposite directions, and thus the magnetic field formed between them can be offset by the opposite flowing currents. Also, the temperature of the system can be controlled by measuring the change in impedance of the thermo-sensitive resin, which is interposed between the first wire and the second wire.

Although the method described above complements some problems associated with a method using an additional temperature sensor or bi-metal, the triple-structured electric heating cable becomes too thick to be employed in a thinner product, for example, a carpet or a blanket. Also, this method still does not reduce the manufacturing costs and shorten the manufacturing time.

SUMMARY

In one aspect, the present invention provides a temperature control device of an electric heater using a thermo-sensitive insulation resin that controls the temperature of the electric heater by sensing the temperature and then generating a control signal in a sensing cycle only, in which a heating current does not flow, so as to prevent a malfunction caused by the voltage drop while sensing the temperature by using the thermo-sensitive insulation resin.

Since electric products are designed with a certain product life, it is common to have a defect, which is caused due to its durability or an external cause, occurred in the products. Particularly, since an electric mat is a product which is often used in direct contact with a user, it is required to have at least a safety device to cut the power off even in the case where a defect occurs and/or the product is out of control.

Also, while the user lies awake on the electric mat, he or she may take an action, for example, pulling out the power plug, when the electric mat is out of control. During the sleep, however, the user is unable to react to such situations due to the body's slower responses, and thus an additional sleep function is required.

The present invention provides a temperature control device of an electric heater using a thermo-sensitive insulation resin that allows the product to be used safely, even in the case where a defect occurs in a temperature sensing circuit of the system or the user is sleeping, by adding an additional safety device.

Also, as described above, the sensing wire method using the thermo-sensitive insulation resin enables the temperature to be accurately controlled because the heat generated in the heating wire is sensed by the sensing wire through the use of the nylon thermo-sensitive resin. However, although a harmful magnetic field may be offset by electrically connecting the heating wire to the sensing wire to form a single heating body, a heating current may also flow through the sensing wire, and the current may flow towards the heating wire, which has a relatively smaller impedance than the nylon thermo-sensitive resin, rather than the nylon thermo-sensitive resin. This makes it difficult to accurately measure the temperature by sensing the current flowing through the nylon thermo-sensitive resin.

In order to implement the present invention that employs the sensing wire method using the thermo-sensitive insulation resin, one complete cycle of the current has to be divided into a heating cycle and a temperature sensing cycle so as to control the temperature accurately and prevent a magnetic field from occurring.

To complement these above problems, the inventor has invented a control device that can control the temperature and offset a magnetic field by using a heating cable structure that is constituted by a heating body and a thermo-sensitive resin only.

To solve the conventional problems described above, the present invention provides a temperature control device that uses the sensing wire method, controls the temperature and block a magnetic field.

In another aspect, the present invention provides a temperature control device using a thermo-sensitive insulation resin that includes a heating wire being connected to an alternating current power source though a SCR, a sensing wire being disposed parallel to the heating wire, a thermo-sensitive resin insulating the heating wire and the sensing wire from each other, in which the impedance of the thermo-sensitive resin changes in accordance with the change in temperature, and a temperature sensing unit, which maintains the temperature at a set temperature by controlling the SCR. Here, the temperature sensing unit generates a temperature control signal to turn the SCR on or off in accordance with a change in electric current flowing through the thermo-sensitive resin. The heating wire is heated by a heating current that flows in the heating cycle, in which a forward voltage is formed in the SCR, and a sensing current that flows in the sensing cycle only, in which a reverse voltage is formed in the SCR. In accordance with an embodiment of the present invention, a harmful magnetic field can be reduced, the control current can be directly controlled by the heating wire such that the temperature control can be accurately conducted, and the number of wires can be reduced.

Additional aspects and advantages of the present invention will be set forth in part in the description which follows, and in part will be obvious from the description, or may be learned by practice of the invention.

DETAILED DESCRIPTION

Figure 5:
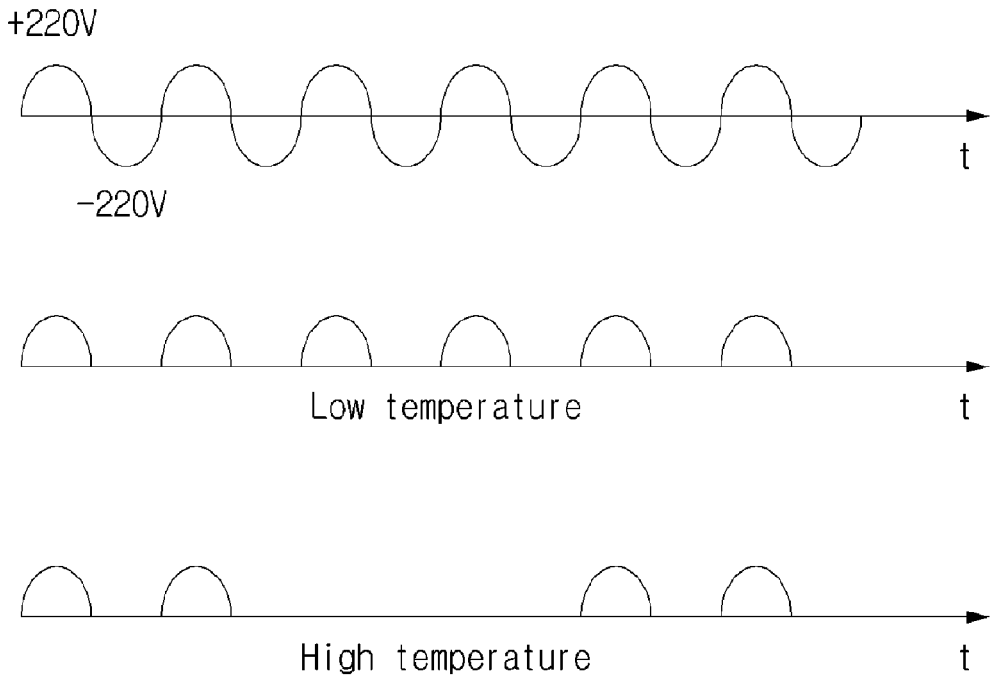
FIG. 5 shows voltage waveforms for describing zero volt Pulse Wide Modulation (PWM).
Figure 6:
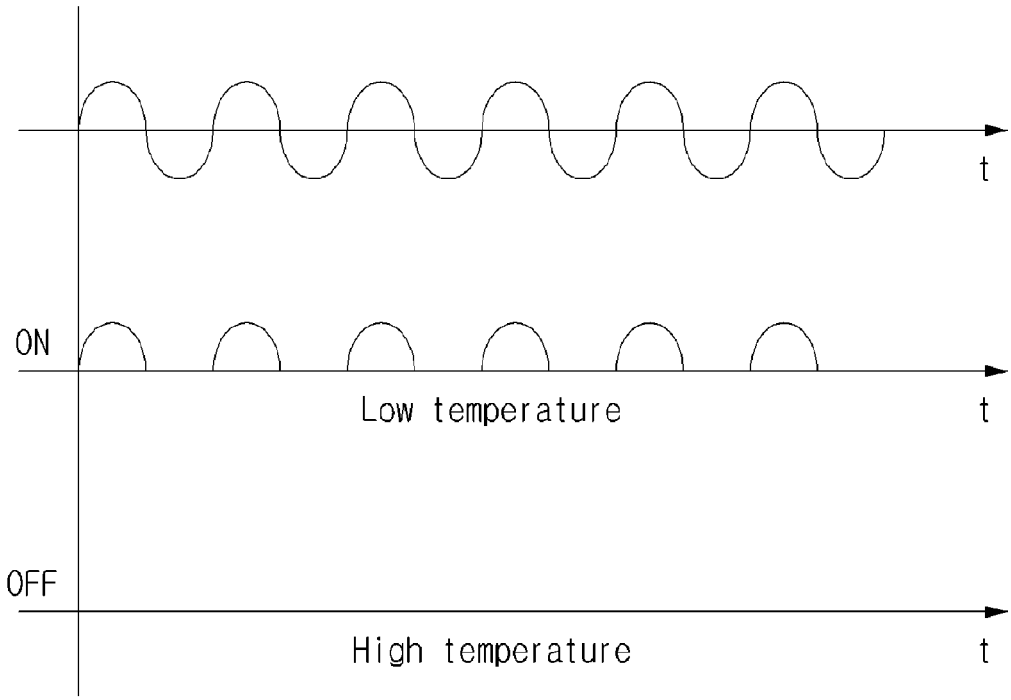
FIG. 6 shows voltage waveforms for describing a zero volt On/Off method.

Currently, the conventional temperature control methods can be broadly divided into two types. One is zero volt Pulse Wide Modulation (PWM), like the one shown in FIG. 5, and the other is a zero volt On/Off method, like the one shown in FIG. 6.

The zero volt Pulse Wide Modulation (PWM) is a way of maintaining the surface temperature of a system at a desired temperature by using the fact that the impedance of a nylon thermistor becomes smaller as temperature increases. The zero volt Pulse Wide Modulation (PWM) does this by first measuring the electric current, then reducing the pulses of electricity supplied to the heating wire and subsequently supplying less power to the heating wire.

The zero volt On/Off method is a way of controlling the system's temperature by having all half-waves inputted when the temperature of the heating wire is lower than the desired temperature, like the PWM, but when the temperature reaches the desired temperature, the power supply may be turned off by having a power control component (in this case, SCR is commonly used) turned off.

Currently, the zero volt On/Off method is used more commonly than the zero volt Pulse Wide Modulation (PWM), because its circuit is simpler, its response is faster, and it has the ability to control temperature with relatively high accuracy.

Figure 7:
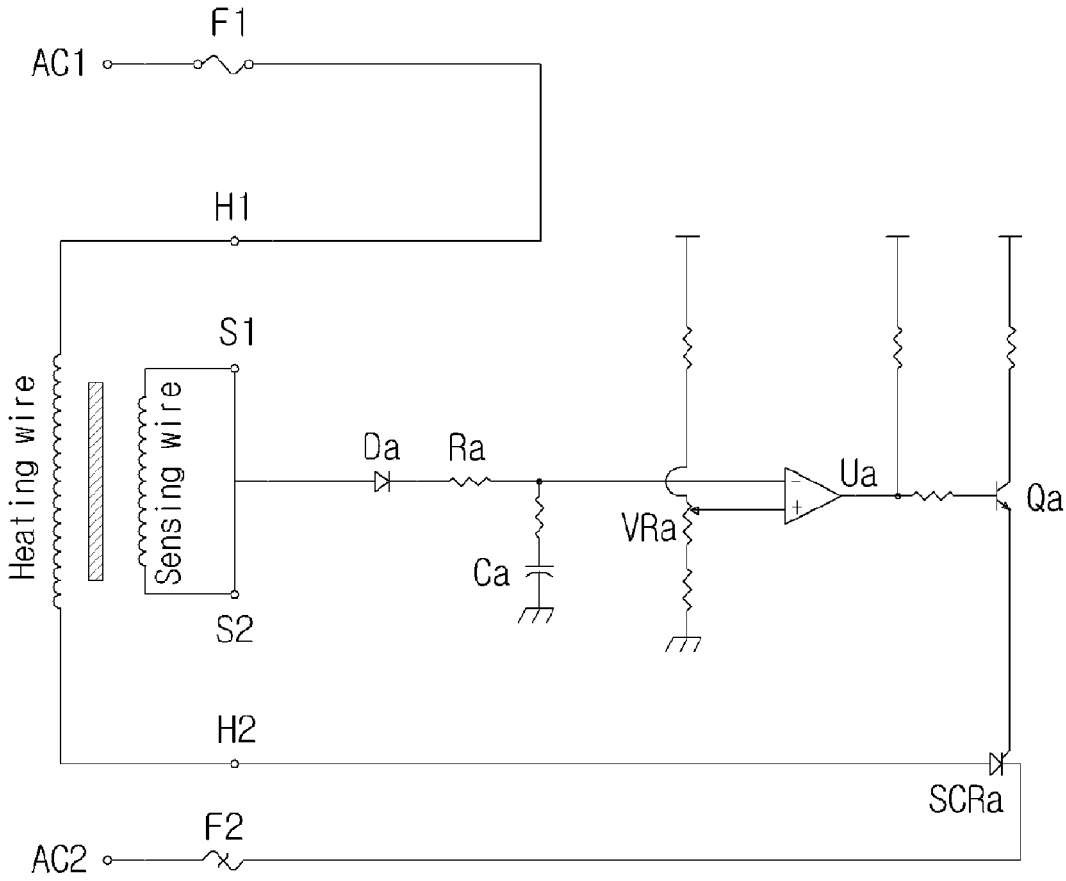
FIG. 7 is a schematic view showing a circuit for describing the principle of a temperature control device using a zero volt On/Off method.

Illustrated in FIG. 7 is a zero volt On/Off type circuit. In this circuit, an electrical current flows through a heating wire positioned between a first heating terminal (H1) and a second heating terminal (H2) when a user connects the circuit to a power source, resulting in heating. Then, a reference voltage, which is inputted into an input terminal of a comparator (Ua), can be adjusted by a variable resistor (VRa) so as to set the temperature.

At this time, an electric current that is driven towards the sensing wire positioned between a first sensing terminal (S1) and a second sensing terminal (S2) can flow through the H1 and H2→a nylon thermistor (N)→the S1 and S2→Da→Ra, be smoothed in Ca and then be inputted into the negative (−) terminal of the comparator (Ua).

If the temperature of the heating wire has not reached the desired (set) temperature, the impedance of the nylon thermistor remains in a high state (here, the nylon thermistor is a negative temperature coefficient (NTC) thermistor). Subsequently, the amount of electric current, passing through the heating wire between the H1 and the H2→the nylon thermistor (N)→the sensing wire between the S1 and the S2, can be small so that its voltage can be detected smaller than the reference voltage set by the variable resistor (VRa).

Therefore, the output of the comparator becomes high, and its signal can be transmitted to a power control component (SCRa) via a transistor (Qa), switching the power control component (SCRa) "on" and thus maintaining a continuous supply of electric power to the connected equipment.

Once the surface temperature of the system's body has reached the desired temperature as the temperature of the heating wire increases, the impedance of the nylon thermistor becomes smaller, increasing the amount of electric current passing through the nylon thermistor. Subsequently, a positive current is inputted into the main electric current by the diode (Da), and then both ends of the condenser (Ca) are charged by the electric current passing through the resistor (Ra), increasing the voltage of the negative (−) input terminal of the comparator (Ua).

If the input voltage in the negative (−) terminal of the comparator (Ua) becomes higher than the reference voltage set by the variable resistor (VRa), the output level of the comparator is inverted from high to low, and the power control component (SCRa) is turned "off," thereby cutting off the supply of electric power.

By repeating these processes, the surface temperature of the system's body can be maintained near the desired temperature set by the variable resistor (VRa).

However, if a local overheating occurs in the heating wire positioned between the H1 and the H2, the controlling of the temperature may introduce another problem that is different from the ones described above.

For example, while the temperature of the heating wire increases, the impedance of the nylon thermistor becomes proportionally decreased. Here, the impedance represents the total impedance the heating wire has, and can be represented in the equivalent circuit of FIG. 8.

In this state, if the temperature increases evenly throughout the heating wire, the combined impedance becomes decreased and thus the amount of electric current being inputted through the sensing wire is increased. If, however, a local overheating occurs in a certain portion of the heating wire, the impedance of that portion becomes smaller than its surroundings, and thus the amount of electric current entering through the portion becomes greater than its surroundings. As a result, the voltage of both ends of the condenser (Ca) can be increased due to the increasing amount of electric current flowing through the diode (Da). Then, the electric power supply has to be cut off by operating the comparator (Ua) in order to reliably control the temperature of the electric heater.

However, when such local overheating is occurred in the heating wire, the amount of electric current being inputted into the sensing wire may be different for the overheated portions even though the same overheating is occurred, thereby deteriorating the reliability.

In other words, since the impedance is decreased in accordance with how much the heating wire is overheated, the amount of electric current being inputted into the sensing wire can be increased accordingly, and thus a control signal to cut the power supply off has to be outputted. In real situations, however, while the impedance of the nylon thermistor is proportionally decreased by the local overheating, the amount of electric current being inputted into the sensing wire can be varied, according to the voltage of the overheated portions. Thus, the change in temperature can not be accurately detected, and the temperature of the system's body may be increased continuously.

In the case of a typical electric mat for two persons, about 34 meters to 40 meters of heating wire is commonly installed. If this type of electric mat is connected to the temperature control device shown in FIGS. 7 and 8, one of the two alternating current (AC) input wires is connected to the heating wire and ultimately to a power control component, and the other one is connected to ground for the circuit.

Figure 8:
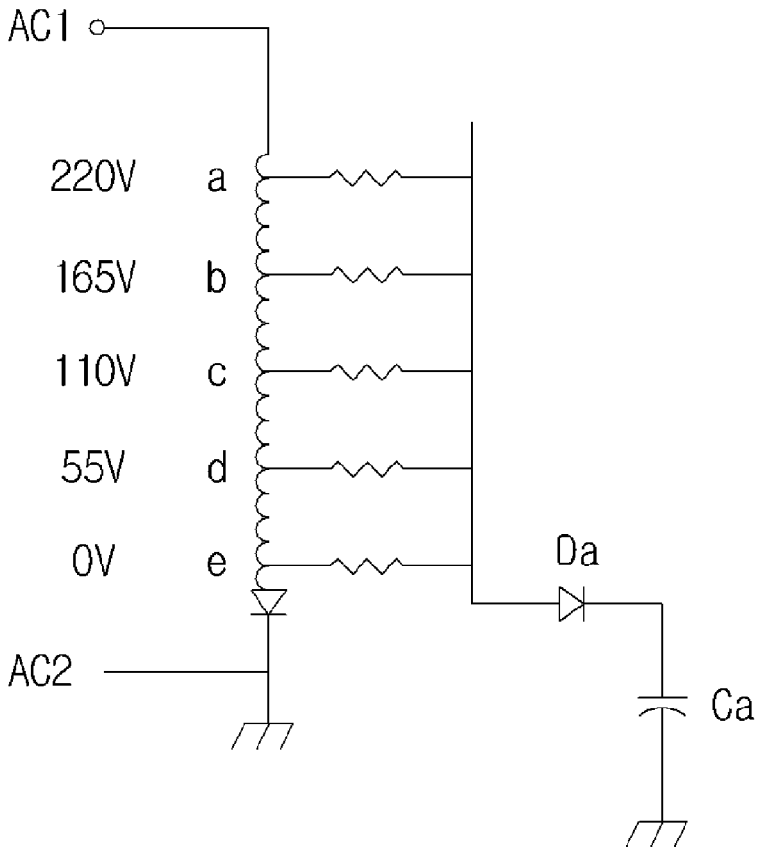
FIG. 8 is a schematic view for describing the voltage of each part of the temperature control device shown in FIG. 7.

In the circuits of FIGS. 7 and 8, an electric current flowing through the heating wire between the H1 and the H2→the nylon thermistor (N)→the sensing wire between the S1 and the S2 can be inputted into the comparator (Ua) via the diode (Da) so as to sense the temperature.

The voltage values at different parts of the heating wire were measured by making AC2 behave as a ground for the circuit. Illustrated in FIG. 8 are the voltage values of the parts according to the voltage drop.

Figure 9:
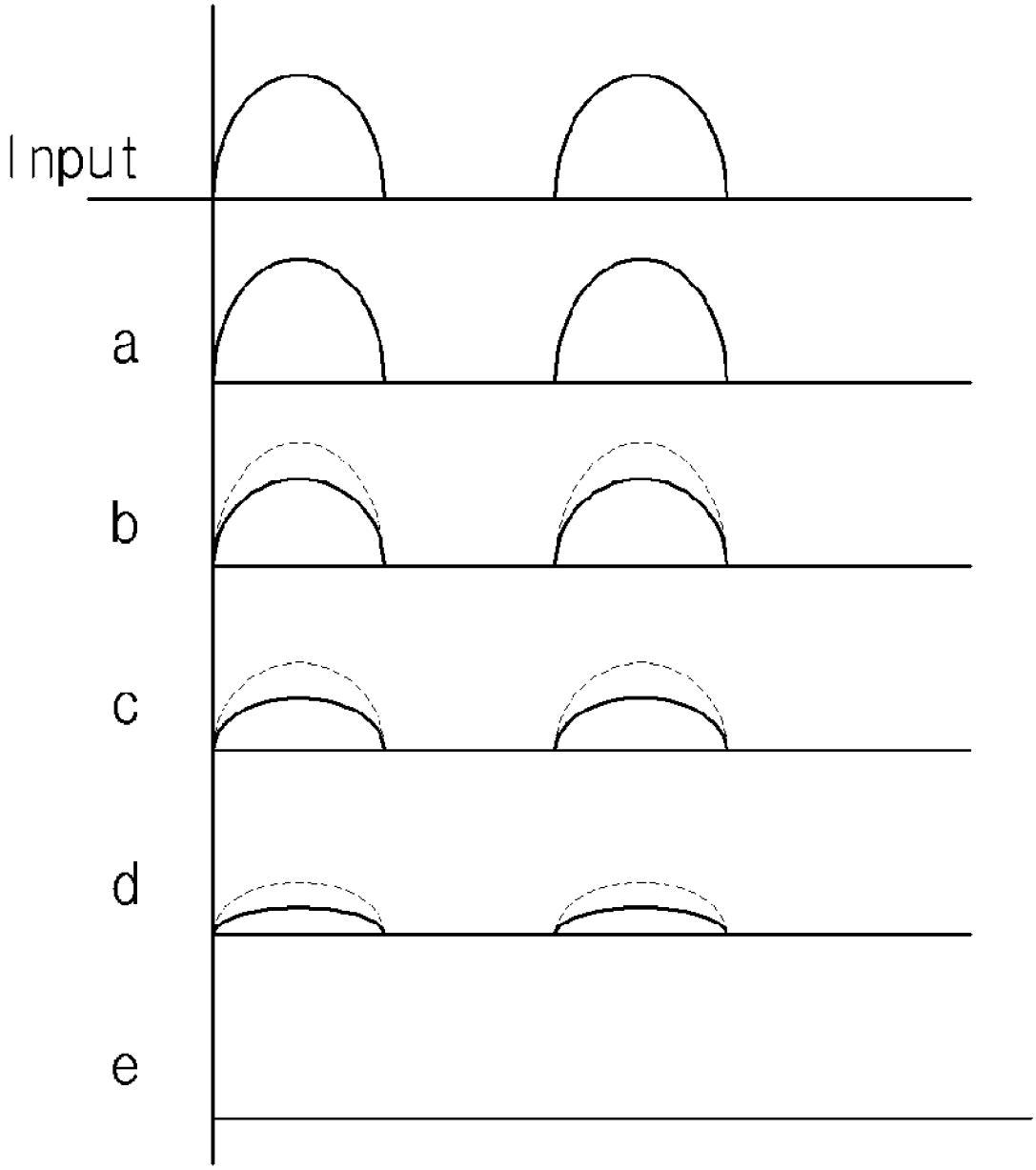
FIG. 9 shows voltage waveform of each part for describing the voltage of each part shown in FIG. 8.

While the temperature of the heating wire increases, the impedance of the nylon thermistor becomes proportionally decreased. When looking at the voltage distribution of the heating wire, through which an electric current flows, by dividing the voltage distribution into sections, the resulting voltage waveforms can be shown in FIG. 9 since the heating wire is an electric heating resistor.

When looking at AC2 as the reference voltage, in this case, a point a of the heating wire becomes a +220V half-wave, and a point b becomes decreased in accordance with how much the voltage drops between the points a and b. That is, the point b becomes +165V, a point c becomes +110V, a point d becomes +55V, and a point e becomes 0V.

In other words, when the temperature of the heating wire increases, the impedance of each part of the heating wire can be decreased proportionally under similar conditions as each part of the heating wire is at the same temperature. However, since the voltage of each part is different from one another, as described above, the magnitude of electric current for each part of the heating wire can vary. Thus, the amount of electric current can vary, depending on each part of the heating wire.

Therefore, the amount of electric current being inputted into the sensing wire can be the total amount of electric current combined by adding the electric current of each part. Afterwards, the combined electric current is smoothed by passing through the diode and then converted into a direct current (DC) voltage.

Therefore, since the temperature of the system's set voltage is set as the highest temperature by combining the electric currents being inputted through the heating wire between the H1 and the H2→the nylon thermistor (N)→the sensing wire between the S1 and the S2, the impedance of the point a and its surrounding area becomes smaller than other areas due to the increasing temperature of the point a and its surrounding area if a portion of the electric mat is folded or a heavy object is placed on the electric blanket (that is, if a local overheating occurs at the point a and its surrounding area). At the same time, since the voltage of the point a is higher than other areas (that is, the voltage is very close to 220V), a large amount of electric current can be driven.

At the same time, the temperature of other areas, i.e., the points b, c, d and e, is not yet increased, and the impedance thereof is higher than the point a. Thus, the amount of electric current being driven through the points b, c, d and e may be smaller. However, since the impedance of the point a is already decreased by the increasing temperature, as compared to other areas, and also the voltage of the point a is the highest among them, the amount of electric current being inputted into the sensing wire through the point a can be greater than through the points b, c, d and e.

If the electric currents flowing through all areas are combined together, a large amount of electric current can be driven through the diode (Da) so that the voltage of both ends of the condenser (Ca) can be rapidly increased. Subsequently, the set voltage can be reached rapidly. As a result, the output of the comparator (Ua) is inverted, and the electric power supply is turned off by the power control component (SCR).

In other words, even though the temperature of other areas excluding the point a has not yet reached the set temperature, the power control device may determine that the set temperature has been reached due to the local overheating of the point a. As a result, the power control device cuts off the electric power supply to the system.

Next, it is assumed in the following description that the point b is overheated. If the temperature of the point b at the time of the overheating is the same as that of the point a, the impedance may also be the same as that of the overheated point a. However, since the voltage is lower than the overheated point a, the amount of electric current being inputted can be smaller than that of the overheated point a. As a result, the amount of electric current being inputted into the diode (Da) is smaller than that of the overheated point a.

Therefore, while the voltage of both ends of the condenser (Ca) reaches the set voltage set by the variable resistor (VRa), the overheated point b takes longer than the overheated point a to reach the set voltage. Thus, the temperature of the heating wire may be further increased before the power supply is cut off, compared to the case where the point a is overheated.

Likewise, if a local overheating occurs at the point c, the amount of electric current being inputted can be further decreased due to the reasons described above, as compared to the local overheating of the points a and b. As a result, it takes even longer time to reach the set voltage by the overheated point c and then finally cut off the electric power supply. Therefore, the heating wire can be further overheated.

Likewise, if a local overheating occurs at the points d and e, the voltage of the points d and e may be dropped below a certain voltage, i.e., 55V or lower, due to the voltage drop. As a result, even though the impedance is decreased due to the increasing temperature of the heating wire, an electric current may not be driven sufficiently enough to reach the set voltage.

In other words, when a local overheating occurs at the points d and e, the temperature control device may not work even though the temperature of the heating wire is already in an overheated state. Thus, the temperature of the heating wire can be further increased continuously to a dangerous level.

Based on the experimental examples described above, a first embodiment of the present invention employs a method of sensing temperature using a sensing wire. In this embodiment, temperature is measured by separating a complete cycle of the alternating current waveform in such a way that the electric current is not allowed to flow through the heating wire while sensing temperatures in order to reduce a local error caused by the voltage drop.

Embodiment 1

Below, a first embodiment of the present invention will be described by referring to FIG. 10.

A temperature control device according to a first embodiment of the present invention is constituted by a power supply unit 11, a temperature sensing unit 12, an overheating protection unit 15, a signal control unit 13, a power control unit 14 and a sleep mode unit 10.

The power supply unit, which is constituted by a rectifier that converts alternating current (AC) to direct current (DC), is a circuit that rectifies an electric current from AC to DC and provides a direct current voltage (Vcc) so as to operate the control circuit.

The temperature sensing unit is a circuit that generates a control signal by detecting a change in electric current, which flows in a direction opposite to the power control component (SCR), through the use of a thermo-sensitive resin (NTC) on alternate temperature sensing cycles, during which a reverse voltage is applied to the power control component (SCR).

The signal control unit is a circuit that generates an operation control signal to operate a switching control component by receiving a signal from the temperature sensing unit 12 and delays the operation control signal.

The power control unit is a circuit that controls and turns on or off the switching control component by receiving a signal from the signal control unit 13.

The overheating protection unit is a circuit that interrupts the flow of electric current in a temperature fuse, which is connected to the circuit, by using the heated resistance when too much current flows in the temperature sensing unit 12 due to short-circuit between the sensing wire and the heating wire.

The sleep mode unit is a circuit that reduces the overall load power by using excessive heat of the heating wire as heat load through the use of a connection switch in such a way that the heating wire may not be overheated in a situation where temperature control malfunctions due to the temperature controller's malfunction during the operation.

Figure 1:
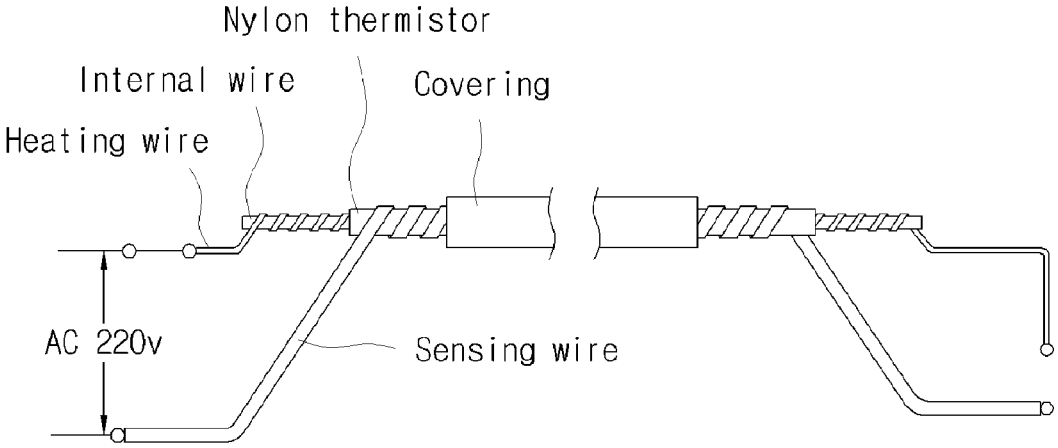
FIG. 1 shows a sensing wire-type heating wire using a nylon thermistor.
Figure 2:
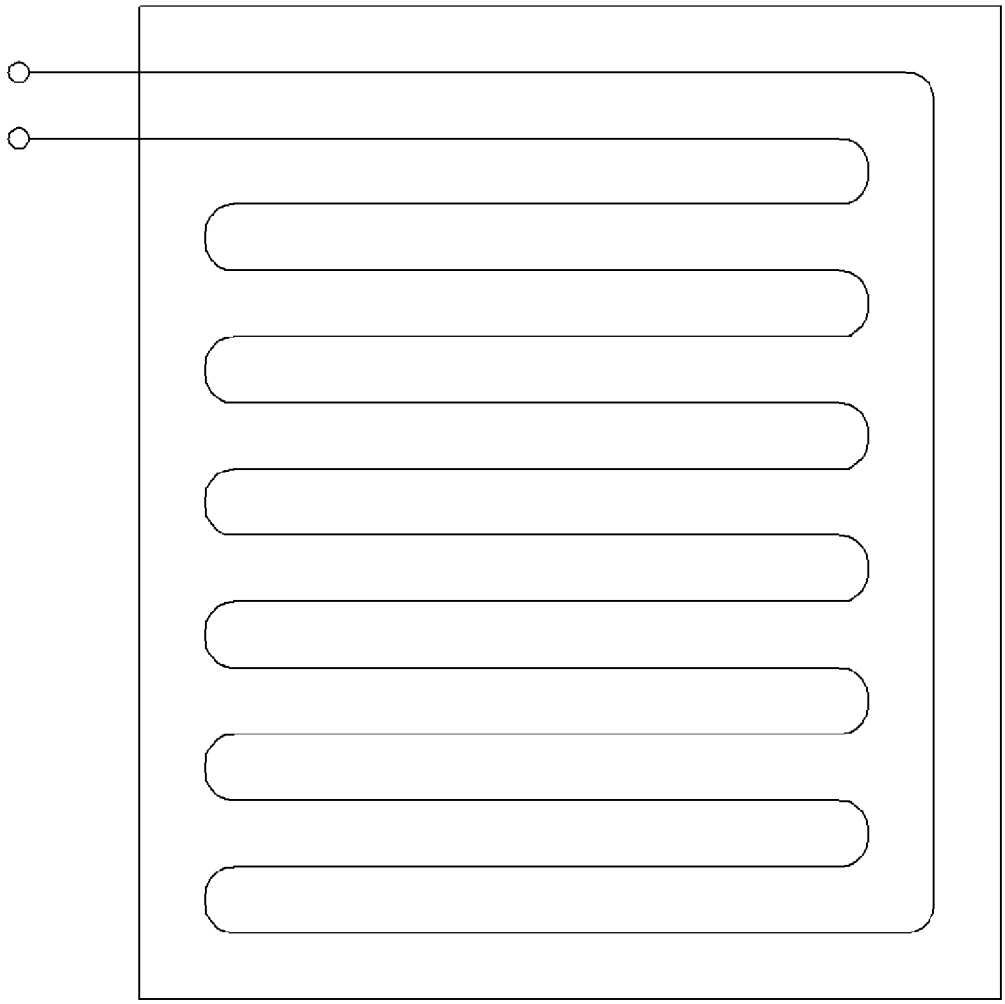
FIG. 2 shows an array structure of a heating wire in an electric mattress pad.
Figure 3:
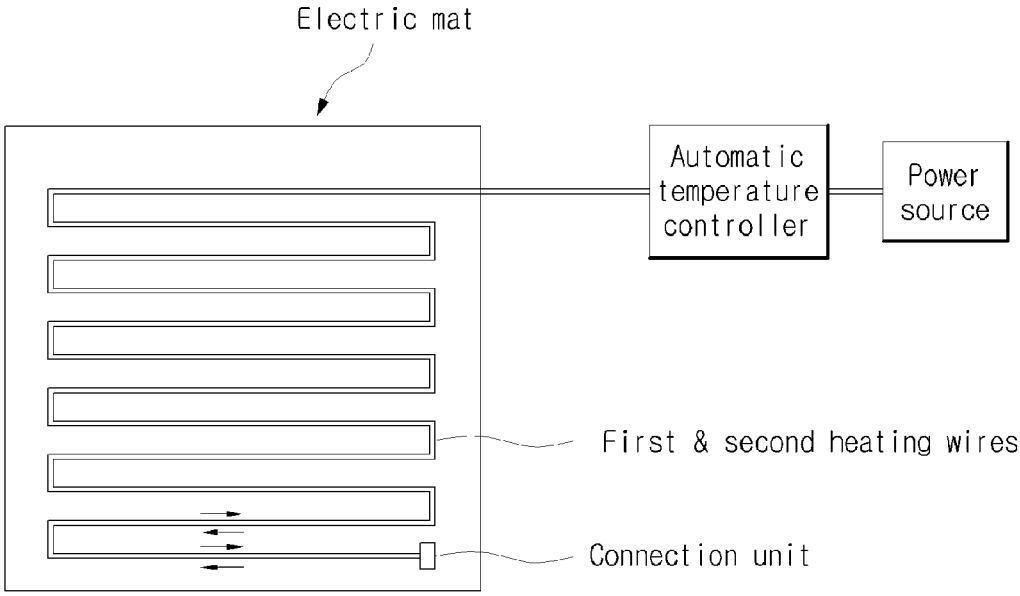
FIG. 3 shows an electric heating cable that is able to offset a magnetic field in accordance with the related art.
Figure 3:
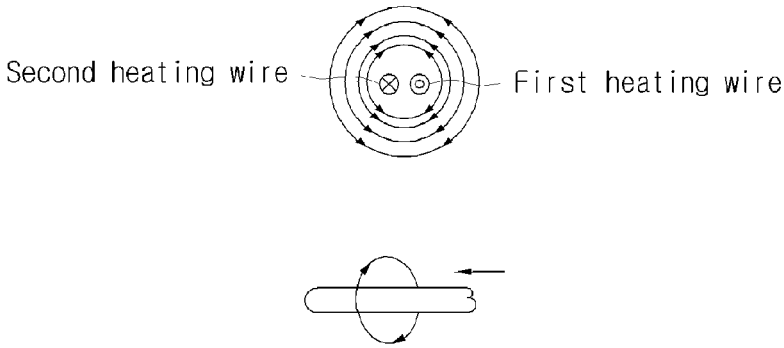
Figure 4:
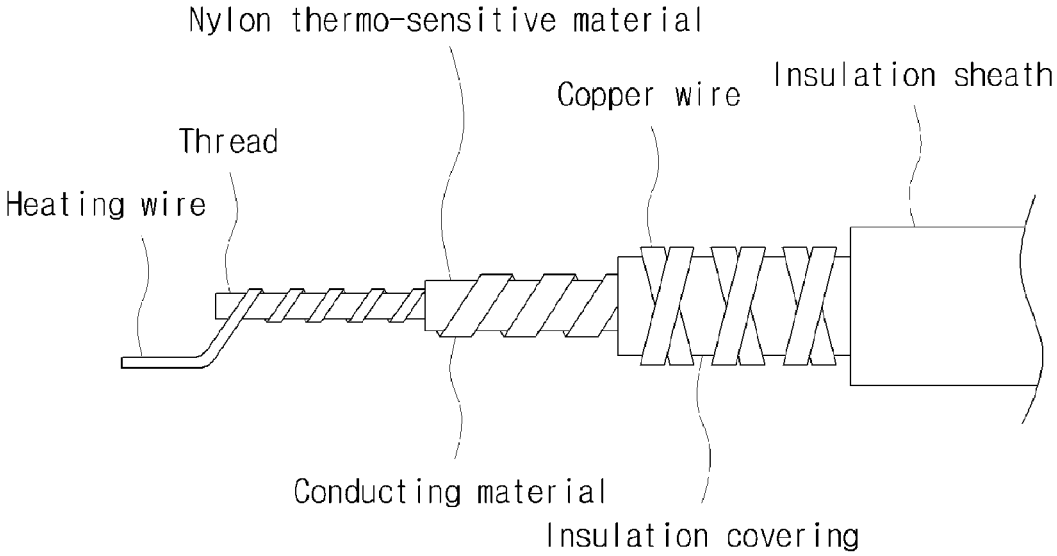
FIG. 4 shows an electric heating cable for offsetting a magnetic field and controlling temperature by using a nylon thermo-sensitive material in accordance with the related art.

FIG. 1 shows a heating cable according to a first embodiment of the present invention. In this cable, a sensing wire (SC) is disposed parallel to a heating wire (HC), and a first sensing terminal (S1) and a second sensing terminal (S2) are respectively connected to either end of the sensing wire. Also, a nylon thermistor (NTC), which is a thermo-sensitive insulation resin, is interposed between the heating wire (HC) and the sensing wire (SC) in such a way that the heating wire (HC) and the sensing wire (SC) are insulated from each other.

Figure 10:
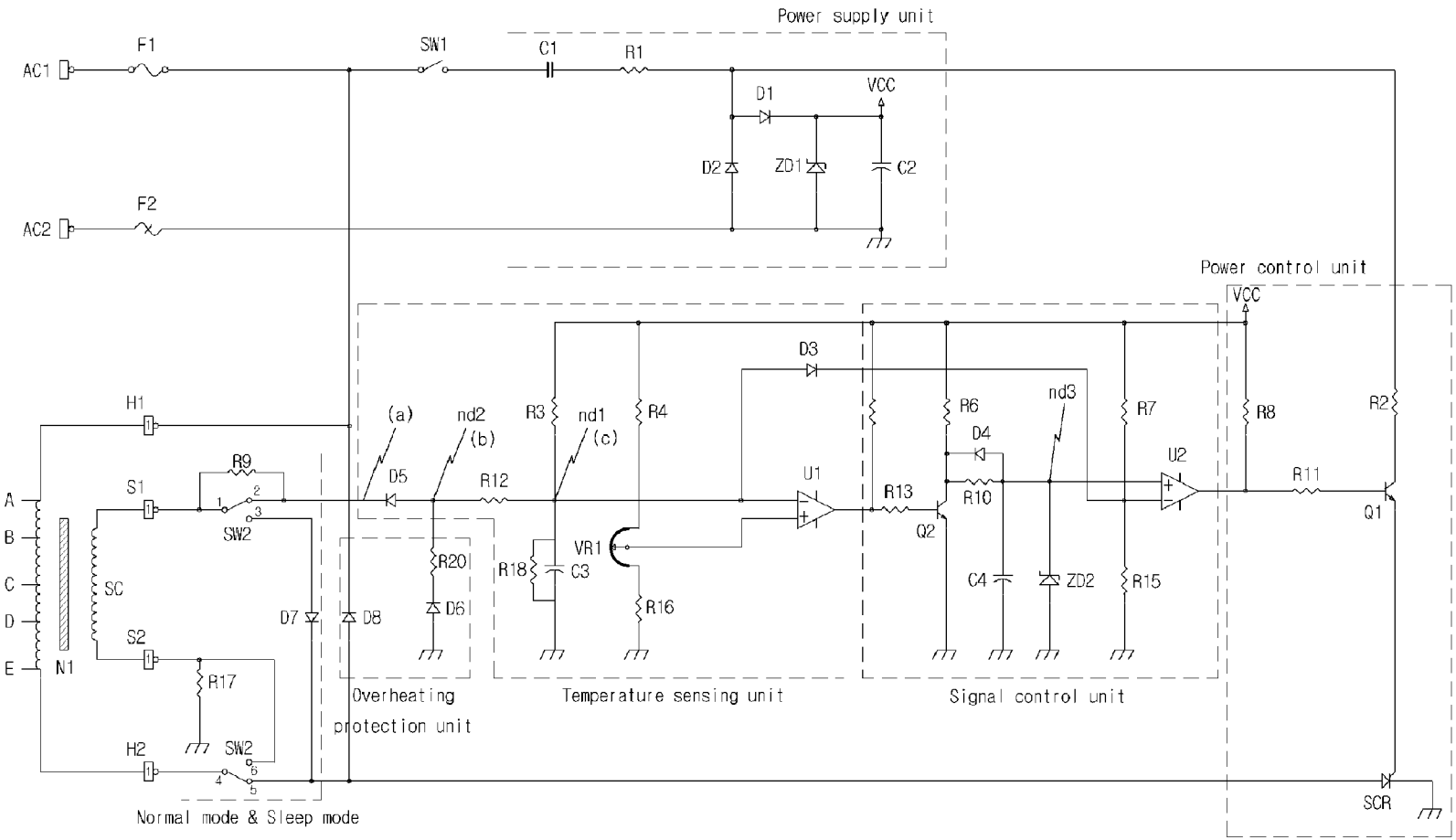
FIG. 10 is a schematic view showing a circuit for describing a temperature control device in accordance with a first disclosed embodiment of the present invention.

As in the example shown in FIG. 10, a first heating terminal (H1), which is connected to a first power terminal (AC1) of alternating current, is connected to the heating wire (HC), and a second heating terminal (H2), which is connected to a second power terminal (AC2) of alternating current, is connected to the heating wire (HC) through SCR. A voltage sensing node (nd1), which outputs a voltage to a first input terminal of a first comparator (U1) in accordance with changes in temperature, is connected to ground (E), which is connected to the second power terminal (AC2), through a first charging condenser (C3). A first sensing unit diode (D5) and a first sensing unit resistor (R12), which are connected to the circuit in a direction opposite to the forward flow of voltage of the SCR, are positioned and serially connected between the voltage sensing node (nd1) and the first sensing terminal (S1).

The SCR is connected in such a way that the direction of electric current flowing from the second heating terminal (H2) to the ground (E) becomes a forward direction in each half cycle of the alternating current.

In heating cycles, in which a forward voltage is formed in the SCR, an electric current of the alternating current power can flow through the first heating terminal (H1)→the hating wire (HC)→the second heating terminal (H2)→the SCR→the ground (E) so as to heat the heating body.

In sensing cycles, in which a reverse voltage is formed in the SCR, voltages being charged into the first charging condenser (C3) by a sensing current can be inputted into the first input terminal of the first comparator (U1) by allowing the sensing current to reversely flow through the nd1, which is divided into several volts by R3 and R18, →the first sensing unit resistor (R12)→the first sensing unit diode (D5)→the first sensing terminal (S1)→the thermo-sensitive resin (NTC)→the first heating terminal (H1)→the first power terminal (AC1).

The voltage of the direct current voltage source (Vcc), which is supplied from the power supply unit, can be inputted into a second input terminal of the first comparator (U1) through a variable resistor (VR1), and the set temperature of the electric heater can be adjusted by adjusting the reference voltage of the first comparator (U1) through the use of the variable resistor (VR1).

When power (SW1) is turned "on," the power supply unit supplies a DC voltage (Vcc) to the main circuit by converting an electric current from AC to DC. In this embodiment, 12V is used as the DC voltage (Vcc).

A user can set the temperature by controlling the variable resistor (VR1).

Here, a set voltage can be inputted into the positive (+) terminal of the first comparator (U1) of the temperature sensing unit, in which the set voltage can be set in a way that the voltage becomes lower when the temperature is higher and the voltage becomes higher when the temperature is lower (in this embodiment, the set voltage is set as 2V when the temperature is 65 degrees Celsius and set as 6V when the temperature is 35 degrees Celsius).

This is because the method used in the present invention controls temperature by using the amount of electric current flowing through a sensing wire→a nylon thermistor→a heating wire, while a typical method of controlling temperature controls temperature by using the amount of electric current flowing through the heating wire→the nylon thermistor→the sensing wire.

In other words, the voltage at both ends of the first charging condenser (C3) becomes lower as the temperature of the heating wire becomes higher by the voltages divided by the R3 and the R18.

In one example, if R3=2 kΩ, R18=10 kΩ and Vcc=12V, the voltage at both ends of the first charging condenser (C3), i.e., the DC voltage of the nd1, in which the voltage is divided by the DC voltage source (Vcc) while the sensing wire is blocked, becomes 10V. If a voltage is applied to the heating wire after the voltage of the negative (−) terminal of the first comparator (U1) is set at a higher temperature in the initial stage, for example, 2V, whereas since the nylon thermistor basically has a higher impedance at a lower temperature, the DC voltage of the nd1 can be decreased from 10V to 7V because a small amount of electric current is allowed to flow from the voltage sensing node (nd1) to the first power terminal (AC1).

Therefore, while the voltage (7V) of the negative (−) input terminal of the first comparator (U1) is higher than the set voltage (2V) of the positive (+) input terminal in the initial stage, the first comparator (U1) maintains the level of output at a lower level, and then a first signal unit transistor (Q2) is turned off. Thus, the voltage of the DC voltage source (Vcc) can be applied to the positive (+) input terminal of a second comparator (U2) through a delay circuit.

As in the example shown in FIG. 10, the delay circuit is a circuit in which a second signal unit resistor (R10) is connected to the circuit between a delay node (nd3), which is the first input terminal of the second comparator (U2), and the collector of the first signal unit transistor (Q2), and a first signal unit resistor (R6) is connected to the circuit between the collector of the first signal unit transistor (Q2) and the DC voltage source (Vcc).

A first signal unit diode (D4) is connected in parallel with the second signal unit resistor (R10) as they are positioned between the delay node (nd3) and the collector of the first signal unit transistor (Q2). A second charging condenser (C4) is connected in parallel with a Zener diode (ZD2) as they are positioned between the delay node (nd3) and the ground (E).

In this embodiment, by having the DC voltage set as 12V and the voltage of the Zener diode (ZD2) set as 8V, 6V can be inputted into the negative (−) input terminal of the second comparator (U2) if R7 and R15 are made to have the same resistance.

The voltage of both ends of the second charging condenser (C4) in the signal control unit can be gradually increased by being charged therein in the order of +12V, R6, R10 and C4 because the first signal unit transistor (Q2) is currently turned off.

In this embodiment, the resistance of the second signal unit resistor (R10) is set in such a way that it takes about 30 seconds for the voltage at both ends of the second charging condenser (C4) to reach 6V.

After elapsing about 30 seconds, if the voltage at both ends of the second charging condenser (C4) exceeds 6V, the output of the second comparator (U2) is switched from low to high for 30 seconds so that TR (Q1) of the power control unit outputs an "On" signal, since the negative (−) input terminal of the second comparator (U2) is set as 6V.

In accordance with the signal of the TR (Q1), the power control component (SCR) is turned on, and then a half-wave current can flow through the heating wire in the order of AC1, F1, H1, H2, SW2, SCR and AC2.

Therefore, after the power is turned on, electric power can be supplied to the heating wire 30 seconds later.

While the current flows through the heating wire, the temperature of the heating wire can be increased, and then the impedance of the nylon thermistor can be gradually decreased.

Here, a voltage that is higher than that of a node (nd2) cannot flow to the temperature sensing unit due to the direction of the first sensing unit diode (D5). Since the impedance of the nylon thermistor decreases with the increasing temperature of the heating wire, the voltage of the point a becomes minus and becomes gradually lower than the electric potential of the nd1 so that a greater amount of electric current can flow.

In one example, if the current flows in the reverse direction, the heating wire can have an electric potential of −220V. In this case, the current can flow through the nd1→R12→D5→SW2→S1 and S2→NTC→H1 and H2→a current fuse (F1)→AC1. Here, the electric potential of the nd1 can be gradually decreased while the impedance of the nylon thermistor decreases.

If the heating wire continues to increase in temperature, the electric potential of the nd1 becomes lower than the voltage (in this embodiment, the set voltage is 2V) set by the variable resistor (VR1). At the same time, the output of the comparator (U1) in the temperature sensing unit can be switched from low to high to output a "high" signal, which is a signal to turn the SCR off, and the first signal unit transistor (Q2) can be turned on.

Here, the 8V voltage, which is charged into both ends of the second charging condenser (C4) of the signal control unit and which is formed by the Zener diode (ZD2), can be discharged through the first signal unit diode (D4) when the first signal unit transistor (Q2) is turned on. At the same time, the voltage at both ends of the second charging condenser (C4) becomes 0V, and the positive (+) input of the second comparator (U2) becomes lower than the reference voltage 6V, which is inputted into the negative (−) input of the second comparator (U2).

Therefore, the output of the second comparator (U2) can be switched from high to low. Subsequently, the TR (Q1) of the power control unit is turned off, and the SCR is also turned off, thereby cutting off the power supply to the heating wire.

In other words, when the output of the comparator (U1) is high, the first signal unit transistor (Q2) is turned on so that the collector terminal is electrically connected to the ground (E), and thus the voltage charged in the second charging condenser (C4) can be discharged through the first signal unit diode (D4). As a result, a command signal to turn the SCR off can be outputted from the second comparator (U2).

Also, when a half-wave current flows through the heating wire between the H1 and the H2 while the SCR is turned on, the points a, b, c, d and e of the heating wire can have different voltages, as in the example shown in FIG. 8. However, if the SCR is turned off, the heating current cannot flow through the heating wire so that the points a, b, c, d and e of the heating wire can have the same 220V voltage when looking at the AC2 as the reference voltage in the reverse direction.

Therefore, the voltage of the point a shown in FIG. 10 can be increased when the SCR is turned off (that is, a greater amount of electric current flows in a descending order of the points a, b and c, and then no electric current flows), then the voltage of the negative (−) input terminal of the first comparator (U1) in the temperature sensing unit can be increased, and thus the output of the first comparator (U1) is immediately inverted so that the first signal unit transistor (Q2) is again turned off. However, since the R10 has a high resistance and the condenser (C4) is set with large capacity, as described above, both ends of the condenser (C4) can be charged gradually with an electric current in the order of +12V, R6, R10 and C4 so that the voltage at both ends of the condenser (C4) can be increased.

For 30 seconds, during which the voltage is increased, the output of the second comparator (U2) maintains low so that the SCR is turned off. After elapsing 30 seconds, the second comparator (U2) of the signal control unit is again inverted from low to high, and the TR (Q1) of the power control unit is turned on, turning on the SCR again. Thus, the electric power can be supplied to the heating wire.

While the above processes are repeated, the amount of electric current flowing in the reverse direction becomes smaller at first so that it may take longer to lower the electric potential of the nd1 to the voltage set by the VR1, since the impedance of the nylon thermistor (NTC) is greater when the temperature of the heating wire is lower. However, if the heating wire is able to keep the heat by increasing the temperature, the impedance of the nylon thermistor (NTC) becomes gradually decreased so that the amount of electric current flowing through can be gradually increased. As a result, the duration of time during which the SCR is turned on can be decreased.

Therefore, since the delay time, during which both ends of the second charging condenser (C4) in the signal control unit are charged, is predetermined, the duration of time during which the SCR is turned "on" becomes shorter as the temperature of the heating wire is increased, and thus the surface temperature of the electric heater remains constant at a certain temperature, if the temperature is equal to or greater than a certain temperature.

Next, a local overheating will be described hereinafter.

If a point A of the heating wire shown in FIG. 10 is overheated so that the point A is hotter than other points B, C, D and E, the impedance of the point A becomes lower than the other points B, C, D and E, as described above, and the electric potential of the point A becomes 220V. Thus, a large amount of electric current can flow through the point A because of the electric potential difference.

However, when an alternating current between the heating wire and the sensing wire flows from AC1 to AC2, the current may be prevented from flowing through due to the direction of the first sensing unit diode (D5). Only if the current flows in a direction that flows from AC2 to AC1 (that is, in a direction opposite to the direction of electric current of the SCR) with each half-wave cycle of the alternate current power, during which the current does not flow in the heating wire, the current can flow through the ground (E)→the first charging condenser (C3)→the voltage sensing node (nd1)→the first sensing unit resistor (R12)→the first sensing unit diode (D5)→ SW2→the first sensing terminal (S1)→the thermosensitive resin (NTC)→the point A→the first heating terminal (H1)→the fuse (F1)→the first power terminal (AC1), and if the temperature is equal to or greater than the set temperature, the electric potential of the voltage sensing node (nd1) becomes lower so that the SCR is turned off, preventing the overheating from occurring.

Described below is a local overheating that is occurred at the point B. According to criteria based on AC2 that is a ground in the circuit, a smaller amount of electric current can flow through the point B since the electric potential of the point B is 175V, if both points A and B have the same impedance level, compared to the point A. However, since the current flowing from AC1 to AC2 is blocked by the direction of the first sensing unit diode (D5), as described above, temperature changes in the temperature sensing unit may not be affected by the current flowing from AC1 to AC2.

When the current flows from AC2 to AC1, the current flowing into the heating wire may be blocked by the power control component (SCR). Nevertheless, the current can flow through nd1→R12→D5→SW2→S1→the point B→H1→F1→AC1, as described above.

That is, since the current does not flow into the heating wire in half-cycles of the alternating current, during which the current flows from AC2 to AC1, the overheated points A, B, C, D and E of the heating wire can have the same electric potential of −220V while the current flows from AC2 to AC1 when looking at AC2 as the reference voltage.

In this way, even though a certain portion is overheated, the current flowing from the voltage sensing node (nd1) of the temperature sensing unit can be increased as much as the impedance is decreased, and the electric potential of the voltage sensing node (nd1) can be lowered because the amount of electric current flowing in the reverse direction is increased. When the electric potential is decreased below the set voltage (that is, the temperature is equal to or greater than the set temperature), the first comparator (U1) outputs a signal to control the temperature to the signal control unit so that the SCR can be turned off, preventing the overheating from occurring.

In this embodiment, if the current flows in the forward direction of the SCR, the heating wire can be heated because of the flowing current. However, the temperature sensing unit cannot sense the current flowing in the forward direction due to the first sensing unit diode (D5) that is connected in the reverse direction.

In other words, while the SCR, which is connected in the reverse direction, is turned off, the temperature sensing unit can sense temperatures so that the current that increases proportionally with the decreasing impedance of the nylon thermistor can be detected even though a certain portion of the heating wire is overheated locally. Furthermore, while the conventional method controls temperature with the amount of electric current flowing in, the present invention controls the temperature with the amount of electric current flowing out, and thus improved reliability can be expected, compared to the conventional method. That is, even though a certain portion of the heating wire is overheated, the temperature of the overheated portion can be accurately sensed, thus making the electric heater safer.

Next, a safe circuit, which is employed in the first embodiment of the present invention, will be described hereinafter.

While the electric heater is in use, the sensing wire may be broken due to overheating or damage. In this case, the electric current flowing into the sensing wire can be decreased, and thus the set voltage corresponding to the set temperature may not be reached even though the temperature is overheated. Consequently, the voltage in the negative (−) input terminal of the comparator (U1) stays higher than the voltage in the positive (+) input side thereof, and thus the SCR physically remains "on" while the temperature of the heating wire continues to increase.

In other words, the function of controlling the temperature is not performed properly.

To prepare such a case, the first embodiment uses a circuit, as in the example shown in FIG. 10, in which a second control unit diode (D3) is positioned between the voltage sensing node (nd1) and the reference voltage input terminal of the second comparator (U2), a first control unit resistor (R17) is serially connected to the circuit between the second sensing terminal (S2) and the ground (E), and a second sensing unit resistor (R3) is positioned between the DC voltage source (Vcc) and the voltage sensing node (nd1).

In this embodiment, the first control unit resistor (R17) has a high resistance value that is just enough not to affect the electric current flowing into the heating wire.

Looking at the operating state of the circuit in normal situations, while the circuit is composed in the order of the electric potential 10V of the voltage sensing node (nd1)→R12→D5→SW2→S1→S2→R17→E, the electric potential of the nd1 is formed with a lower voltage than 10V while being connected with the heating wire (in this embodiment, the electric potential is set as equal to or lower than about 7V by adjusting the value of R17) since the nylon thermistor has a basic impedance at room temperature.

While the circuit is set in this way, if the sensing wire is broken, electrical connection to the ground may be broken by R17, and the electrical potential of nd1 may be increased so that the 10V voltage may be inputted into the negative (−) input terminal of the second comparator (U2) through the second control unit diode (D3). When the sensing wire is broken by an unknown cause, the 10V voltage can be inputted into the input of the second comparator (U2) by the second control unit diode (D3) since the positive (+) input terminal of the second comparator (U2) is set as 6V and the negative (−) input side thereof is set by the Zener diode (ZD2) so as not to exceed 8V, as described above.

Therefore, the output of the second comparator (U2) is switched from high to low, and then the SCR is turned off, thereby cutting the power supply off.

Also, if the circuit malfunctions due to the electric components' defect or partial damage and thus continuously overheated (that is, temperature control is not performed properly), the temperature of the heating wire may be increased continuously.

In case the heating wire continues to rise up to 120 degrees Celsius or greater due to a malfunction of the circuit, the overheated portion of the nylon thermistor may be melted, causing a short-circuit between the heating wire and the sensing wire.

To prepare such a case, the first embodiment of the present invention shown in FIG. 10 uses an overheating protection unit that is connected with a short sensing node (nd2), which is connected to the anode of the first sensing unit diode (D5), through an overheating protection unit diode (D6) and a heating resistor (R20), which are serially connected to the ground (E).

A temperature fuse (F2) is serially connected to the circuit between one of the two alternating current terminals and one access terminal of the heating wire, and can be installed adjacent to the heating resistor (R20). Therefore, when the heating resistor (R20) is overheated to exceed the set temperature, the power supply of alternating current can be cut off.

In such a case, if a short-circuit occurs between the heating wire (HC) and the sensing wire (SC), an electric current can flow in the reverse direction through the ground (E)→the overheating protection unit diode (D6)→the heating resistor (R20)→the short sensing node (nd2)→the first sensing unit diode (D5)→the first sensing terminal (S1)→the short-circuit point of the thermo-sensitive resin (NTC)→the first heating terminal (H1)→the first power terminal (AC1) in each sensing cycle. That is, when a large short-circuit current flows through the heating resistor (R20), the heating resistor (R20) can be heated, and the temperature fuse (F2), which is closely positioned to the heating resistor (R20), can be broken so that the electric power supply is cut off, preventing an accident caused by the short-circuit.

Since the overheating protection unit has the capability to operate without the direct current voltage (Vcc), it can be operated safely even if the direct current voltage (Vcc) is not supplied to the overheating protection unit due to a malfunction of the power supply unit.

In case an electrical connection is formed between two nodes of the circuit due to the power control component (SCR)'s malfunction, a full-wave of input voltage may flow instead of a half-wave, and a direct connection may be formed. This may cause an overheating effect that consumes electric power by twice.

To prepare such a case, an overcurrent fuse (F1) can be installed between the first power terminal (AC1) and the first heating terminal (H1), as in the example shown in FIG. 7. Also, the anode of a fourth control unit diode (D8) can be connected to the anode of the SCR, and one end part of the overcurrent fuse (F1) can be connected to the cathode of the fourth control unit diode (D8).

In other words, in case an electrical connection is formed in the SCR due to the SCR's malfunction, an operating current can flow like the usual flow with each heating cycle. In sensing cycles, however, an overcurrent can flow through AC2→the SCR (where an electrical connection is formed) →the fourth control unit diode (D8)→the overcurrent fuse (F1)→the first power terminal (AC1). This results in a broken connection between the current fuse (F1) and the circuit.

Generally, when an electric mat is used for sleeping, careful attention is required, and thus an additional function may be required.

Unlike when an electric mat is used while a user lies awake on the electric mat, it may cause a fire or a serious burn on the user because the user is unable to react to critical situations due to the body's slower responses during the sleep if a temperature control device of the electric mat malfunctions. To prepare for such a case, an additional safety feature may be required so as not to increase the temperature of the heating wire even in the worst case scenarios.

In other words, an additional device that introduces a sleep mode so as to prevent the heating wire from overheating, even in the case where the temperature control malfunctions due to the temperature control device's malfunction, is required.

A number of experiments have been conducted to test the temperature increase of an electric heater in accordance with the load electricity. The test results show that if one fourth (¼) of the rated electric power is supplied, the temperature increase of a heating wire is relatively smaller even though sufficient time is elapsed. This is because its energy is lost to the outside environment. Thus, the surface temperature may not exceed 40 degrees Celsius.

A typical electric mat for two persons may be manufactured to use about 200 watts of electric power. If an SCR, which uses a half-wave, is used as a power control component, the resistance of the heating wire may be around 120Ω (if, the input voltage is 220V), and the resistance of the sensing wire may be around 360 Ω.

Therefore, by directly connecting the heating wire to the sensing wire to use its load electricity as heating load electricity, the load electricity becomes one fourth of the rated power.

In the first embodiment, as shown in FIG. 10, while a connection switch (SW2) is in a normal mode, the heating wire (HC) is connected to the alternating current power through the SCR by use of the switch (SW2), the sensing wire is connected to the temperature sensing unit, and the SCR is controlled by a sensing signal of the temperature sensing unit, which is operated in accordance with the changes in electric current of the sensing wire that flows through the thermo-sensitive insulation resin.

In a sleep mode, however, the sensing wire (SC) is disconnected to the temperature sensing unit by the connection switch (SW2), and can be serially connected to the heating wire (HC) (in FIG. 10, the connection switch (SW2) is currently connected in a normal mode).

In other words, when the connection switch is in the sleep mode, the connections 1→2 and 4→5 of the connection switch (SW2) can be switched to 1→3 and 4→6, respectively.

As shown in FIG. 10, in the normal mode, the second heating terminal (H2) is connected to the anode of the SCR by the connection switch (SW2), and the first sensing terminal (S1) is connected to the temperature sensing unit by the connection switch (SW2). In the sleep mode, by the switching connection of the connection switch (SW2), the second heating terminal (H2) is connected to the second sensing wire (S2), and the first sensing terminal (S1) is connected to a fifth control unit diode (D7) and finally to the anode of the SCR via the fifth control unit diode (D7).

In the normal mode, about 200 watts of electric power may be consumed in the heating wire, a surface temperature of about 30 degrees Celsius to 60 degrees Celsius may be produced, and the temperature may be controlled by the sensing wire. However, when the SW2 is switched to a sleep mode, an electric current can flow through AC1→F1→H1→H2→SW2→S2→SW2→D7→SCR→AC2 so that the heating wire and the sensing wire can be serially connected.

When the heating wire and the sensing wire are serially connected to each other, the combined resistance becomes 480Ω, and the power consumption can be one fourth of the rated electric power, i.e., about 50 warts.

Therefore, while the electric mat is in use without employing any additional temperature control process, the surface temperature of the electric mat does not exceed 40 degrees Celsius.

Even if the power control component malfunctions due to short-circuit while the user is sleeping, it can be controlled by the half-waves so that the power consumption can be constant at a certain value, since the fifth control unit diode (D7) is connected in the forward direction, like the SCR, to the circuit between the first sensing terminal (S1) and the anode of the SCR.

While the user uses the sleep mode of the switch, an overheating phenomenon can be prevented from occurring without modifying an additional temperature control device.

Although a logic circuit is used for easy understanding of the present invention, it shall be apparent that the present invention can also use a micro computer.

Furthermore, a resistor (R9) is connected to the circuit between both ends of the SW2. This is because the temperature sensing unit is disconnected from the sensing wire by the SW2 when the switch is switched to a sleep mode. Also, this is to prevent the SCR from being turned off when the voltage is increased to 10V through D3, as described above.

Embodiment 2

In this embodiment, a temperature control device of an electric heater, which uses a thermo-sensitive insulation resin with the same technical principle as that of the first embodiment of the present invention, has a structure in which a magnetic field radiating to the outside is offset by allowing the heating current to reversely flow from the heating wire to the sensing wire (that is, the electric currents flowing through the heating wire and the sensing wire flow in opposite directions so as to offset the magnetic field).

Below, the configuration of the present invention will be described with reference to the accompanying drawings.

A heating cable that is used in the present embodiment has the same structure as that of FIG. 1. In this embodiment, however, the sensing wire can be used as a heating wire in a normal use.

In this embodiment, the sensing wire is used as a second heating wire.

Figure 11:
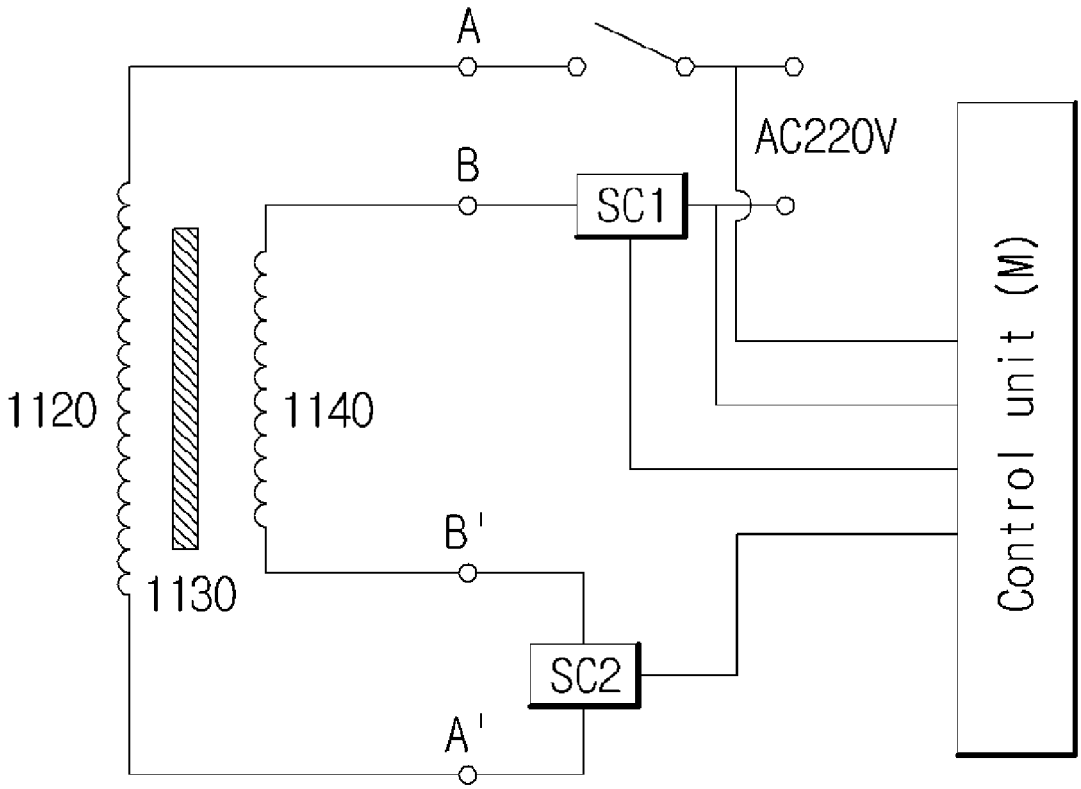
FIG. 11 is a schematic view showing a circuit for describing a temperature control device in accordance with a second disclosed embodiment of the present invention.

The circuit shown in FIG. 11 has a structure in which one end part of the heating wire is connected to a source of electric power and the other end part of the heating wire is connected to the sensing wire (the second heating wire) through a second switching control component (SC2). With this arrangement, a magnetic field radiating to the outside can be offset by the electric currents flowing in opposite directions.

FIG. 11 illustrates a concept of a temperature control device according to an embodiment of the present invention.

Illustrated in FIG. 11 is a heating cable that is constituted by two heating wires 1120 and 1140, which are composed of a heating wire and a sensing wire, and a thermo-sensitive insulation resin 1130, which is positioned between the heating wires 1120 and 1140. The power can be supplied to the heating cable through a first switching control component (SC1), which is positioned on one side of terminals A and B of the two heating wires 1120 and 1140. Electrical connection to the circuit can be controlled by making terminals A' and B' of the two heating wires 1120 and 1140 connected to the second switching control component (SC2).

In this embodiment, the first and second switching control components can be defined as an electric component, for example, a diode, an SCR (silicon controlled rectifier), a TRIAC, a TR and a switching IC, that switches the power by the constant or reverse voltage of both terminals or a control signal of an external device.

While an alternating current is supplied to the terminals A and B, power can be supplied through alternating cycles of heating and sensing. In the heating cycle, an electric current flows through the heating wires so as to increase the temperature of the electric heater. In the sensing cycle, the electric current flowing through the heating wires is blocked, and then the flow of electric current is directed towards the thermo-sensitive resin only so that the temperature can be measured.

In this embodiment, the heating cycle can be defined as a cycle in which an electric current flows through the two heating wires such that the two heating wires radiate heat. Likewise, the sensing cycle can be defined as a cycle in which an electric current flows through the thermo-sensitive resin so as to measure the surrounding temperature of the heating wires while the two heating wires are electrically disconnected.

In other words, while the first and second switching control components are connected to a control unit (M), the first and second switching control components can be controlled in such a way that a heating current can flow through the two heating wires in the heating cycle. In the sensing cycle, however, while the two heating wires are electrically disconnected from the circuit by the first and second switching control components, the first and second switching control components can generate a control signal by the control unit (M) such that an electric current can only flow through the thermo-sensitive insulation resin positioned in between the two heating wires.

In the sensing cycle, therefore, while the heating wires are electrically disconnected from the circuit, the electric current only flows through the thermo-sensitive insulation resin 1130. Then, by measuring a change in electric current flowing through the thermo-sensitive insulation resin 1130, the changes in impedance of the thermo-sensitive insulation resin 1130, which changes according to the temperature, can be detected.

Therefore, by sensing a change in electric current flowing through the thermo-sensitive insulation resin 1130, the temperature of the electric heater can be accurately measured, making it possible to control the temperature.

In this way, when the measured temperature exceeds the set temperature, the control unit (M) senses the change and controls the first switching control component (SC1) to be opened, making it possible to control the temperature accurately.

Also, in the heating cycle, the electric currents flowing through the first heating wire 1120 and the second heating wire 1140 flow in opposite directions, and thus a magnetic field can be offset by the two oppositely flowing currents. This results in reduced harmful magnetic field.

The circuit shown in FIG. 11 can also include a cycle control circuit, which is for controlling the first and second switching control components periodically, and a temperature sensing unit, which is for controlling the temperature.

Embodiment 3

Figure 12:
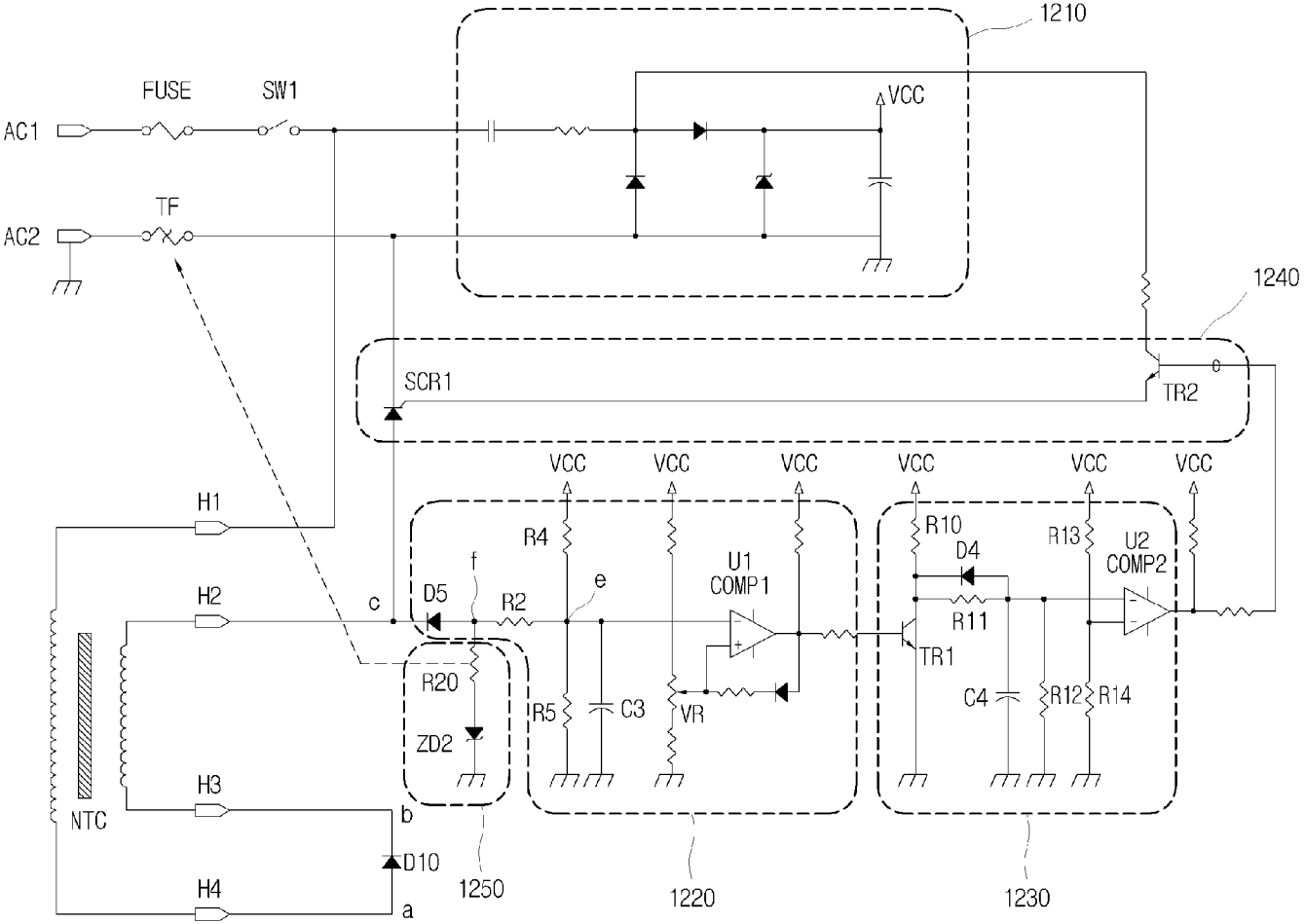
FIG. 12 is a schematic view showing a circuit for describing a temperature control device in accordance with a third disclosed embodiment of the present invention.

A third embodiment of the present invention shown in FIG. 12 presents a circuit that is designed for implementing the second embodiment of the present invention in a more economical and reliable way.

In this embodiment, each of the heating cycle and the sensing cycle becomes a half-cycle, and the first and second switching control components are used as a rectifying component. As a result, the overall number of circuit components can be reduced, and this arrangement can make a simpler and more reliable circuit.

FIG. 12 shows a circuit of a temperature control device according to the third embodiment of the present invention.

The heating cable of FIG. 12 has the same structure as that of FIG. 1. For better understanding, however, the heating wire of FIG. 1 is referred to as a first heating wire, and the sensing wire of FIG. 1 is referred to as a second heating wire.

In other words, a heating cable that is constituted by two heating wires and one thermo-sensitive insulation resin can be used.

As in the example shown in FIG. 12, a temperature control device according to this embodiment is constituted by first and second heating wires, a power supply unit 1210, a temperature sensing unit 1220, a signal control unit 1230, a power control unit 1240 and an overheating protection unit 1250. Here, the operating principle of each unit can be the same as those of the first embodiment of the present invention.

In FIG. 12, one end part of the first heating wire and one end part of the second heating wire are serially connected electrically to a rectifying component (in this embodiment, a diode D10 is used). Also, power can be supplied to the circuit through the other end part of the first heating wire and the other end part of the second heating wire. Here, one of the other end part of the first heating wire and the other end part of the second heating wire supply an alternating current through a silicon controlled rectifier SCR1.

As in the example shown in FIG. 12, the third embodiment of the present invention simplifies the temperature control device by only connecting a rectifying component D10 to the end parts of the first and second heating wires, allowing alternating cycles of heating and sensing to occur.

In the half cycle, in which a forward voltage is formed in the diode D10 (that is, in the heating cycle), a half-wave current of alternating current supplied from the alternating current source can flow in the forward direction through the first heating wire→the diode D10→the second heating wire, so as to heat the first and second heating wires.

In the heating cycle, the electric current flowing through the two heating wires can flow in opposite directions since the two heating wires and are disposed in parallel and connected by the diode D10. Thus, a magnetic field being formed between the two heating wires can be offset by the oppositely flowing currents. This arrangement can reduce the harmful magnetic field.

In the half cycle, in which a reverse voltage is formed in the diode D10 (that is, in the sensing cycle), the other half-wave current of alternating current can flow in the reverse direction only through the thermo-sensitive insulation resin (in this embodiment, a nylon thermistor (NTC) is used), which is interposed between the first and second heating wires, from the ground of the temperature sensing unit 1220, since the first and second heating wires are electrically disconnected by the diode D10.

Since the current flows through the temperature sensing unit 1220, the temperature sensing unit 1220 can detect the current flowing through the thermo-sensitive insulation resin (NTC) and generate a control signal according to a change in electric current.

While the temperature of the heating wires is below normal temperature, the SCR1 remains to be turned on, and another alternate heating cycle occurs in the following half cycle. In a range of normal temperatures, the heating wires can be heated through the alternating cycles of heating and sensing while a harmful magnetic field is offset by the opposite currents.

When the temperature of the electric heater exceeds the set temperature, the SCR1 generates a control signal according to the sensing current, which only flows in the sensing cycle, so as to prevent a malfunction caused by the voltage drop, like the first embodiment of the present invention.

In this embodiment, the operation of the control circuit according to the temperature is substantially the same as that of the first embodiment described above, and will be described below in more detail.

First, in a heating cycle, i.e., for 1/120 second, which is the first half cycle, a half wave can flow through AC1→H1→H4→D10→H3→H2→SCR1→AC2.

In the following half cycle, in which an electric current flows in a direction from the AC2 to the AC1, a reverse voltage can be formed in the diode D10 so that a reverse current cannot flow through the heating wire.

When the temperature of the heating wire increases, the capacity of the nylon thermistor can increase because the nylon thermistor is a negative temperature coefficient (NTC) thermistor. That is, the impedance of the nylon thermistor can be decreased.

As described above, in the first half cycle, an electric current can flow through AC1→H1→ H4→D10→ H3→H2→ SCR1→AC2, and the electric potential of a point c can be the same as that of the ground.

On the other hand, an electric current, which flows in a direction from the AC2 (ground) to the AC1, can flow through AC2 (ground)→R5→R2→D5→H2→NTC→H1→AC1. While the temperature is low, a very small amount of electric current can flow, but when the temperature slowly increases, the amount of electric current can also increase.

That is, since the electric potential of the point c is lowered towards minus, the electric potential level can also be lowered.

Therefore, while the temperature increases, the electric potential of the point c becomes proportionally lowered, falling to minus. Thus, the electric potential of a point e of the temperature sensing unit 1220 becomes relatively higher than the point c so that an electric current can flow through the point e→R2→D5→the point c→H2→NTC→H1→AC1.

Therefore, heating only occurs when an electric current flows in the forward direction from the AC1 to the AC2, and no temperature is detected by the NTC. However, when the electric current flows in the reverse direction from the AC2 to the AC1 through the heating wire, the current may be blocked by the SCR1 and the D10. Thus, a half-wave current can only flow through the nylon thermistor (NTC). Since the nylon thermistor changes its impedance according to the temperature, the electric potential of the negative (−) input terminal of a comparator (COMP1) in the temperature sensing unit 1220 can be changed.

While the temperature of the heating wire increases, the electric potential of the point e is lowered. Thus, when the electric potential of the point e is lower than the voltage set by the VR1, the output of the comparator (COMP1) is switched from low to high.

As such, when the output is switched from low to a high, the TR1 of the signal control unit 1230 can be turned on, and the current charged into the second charging condenser (C4) can be discharged instantaneously through the first signal unit diode (D4). Then, the output of a comparator (COMP2) of the signal control unit 1230 can be switched from high to low, and the TR2 of the power control unit 1240 can be turned off so that the SCR1 can also be turned off.

When the SCR1 is turned off, the electric potential of the point c becomes higher, and the voltage in the negative (−) input terminal of the comparator (COMP1) of the temperature sensing unit 1220 becomes higher than that of the positive (+) terminal thereof.

The output of the comparator (COMP1) is switched again to low when the SCR1 is turned off. However, since the electric potential of both ends of the C4 in the signal control unit 1230 is slowly increased, whereas an electric current flows slowly to both ends of the C4 through Vcc→R10→R11→R12, the negative (−) input of the signal control unit 1230 can be increased as much as the duration of time set by the time constant of R11 and C4, and thus the operation of the TR2 can be delayed as much as the duration of time set by the time constant.

Such delay circuit is for preventing the SCR1 from rapidly turning on and off repeatedly, and it shall be apparent that any method can be substituted for the delay circuit.

In one example, this can be simply controlled by using a microcomputer.

In case the temperature of the heating wire increases due to any reason, a safety device may be required.

In the present embodiment, when a certain portion of the heating wire rises up to 120 degrees Celsius or higher, the nylon thermistor may melt so that a short-circuit can occur in any portion, one of which being between H1 and H4 and the other of which being between H2 and H4, of the heating wires.

As such, in cases where the insulation between the heating wires is broken so that a short-circuit occurs between them, the system cannot detect the short-circuit in 1/120 second of half cycle, in which an electric current flows from the AC1 to the AC2. Conversely, in another 1/120 second of half cycle, in which an electric current flows from the AC2 to the AC1, the current can flow through AC2 (ground)→ZD2→R20→D5→H2→the shorting point→H1→AC1, and thus the heating resistor (R20) of the overheating protection unit 1250 can be heated.

In other words, an electric circuit can be formed between the AC2 (ground) and the H2 through ZD2→R20→D5, as described above. As in the example shown in FIG. 12, a heating resistor R20 that is serially connected to the diode D5 and the Zener diode ZD2, which are positioned between the AC2 (ground) and the point c, can be connected with the SCR1 in parallel when looking at the point c as a reference point.

A temperature fuse TF is disposed in such a way that the temperature fuse can be physically connected to the heating resistor R20. In this way, while the heating resistor R20 is heated and reaches a certain temperature, the temperature fuse TF can be disconnected so that the power supply can be cut off.

The resistance value of the heating resistor R20 can be set 10 to 30 times higher than that of the heating wires.

A test was conducted in accordance with an embodiment of the present invention. In this test, the resistance of the heating wires was in the range between 100Ω and 200Ω, and the resistance of the heating resistor R20 was in the range between 1 kΩ and 3 kΩ. The test results show that when a short-circuit occurred, the heating resistor was rapidly heated in 5 to 10 seconds so that the temperature fuse was disconnected from the circuit.

The overheating protection unit 1250 can heat the heating resistor by using the breakdown voltage of the Zener diode ZD2 only if the voltage, which is determined by the electric current flowing through the temperature sensing unit 1220, exceeds a certain electric potential.

In other words, if the electric potential of a point fin the temperature sensing unit 1220 exceeds the electric potential of the Zener diode ZD2 in the overheating protection unit 1250, an electric current can flow so that the heating resistor R20 can be heated.

Also, the decreasing speed of the electric potential according to the increasing temperature can be determined by the resistance of a resistor R2.

In this embodiment, the heating resistor R20 can be heated by using the Zener diode with a breakdown voltage of 30V when the electric potential of the point f exceeds 30V, while looking from the circuit ground, and when an AC half-wave current flows due to the short-circuit.

Figure 13:
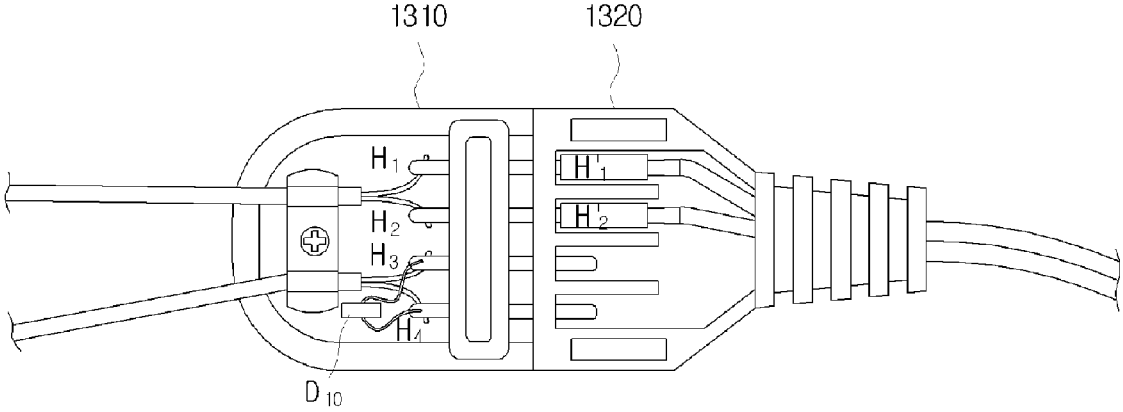
FIG. 13 shows the structure of a connection terminal unit in accordance with the third disclosed embodiment of the present invention.
Figure 14:
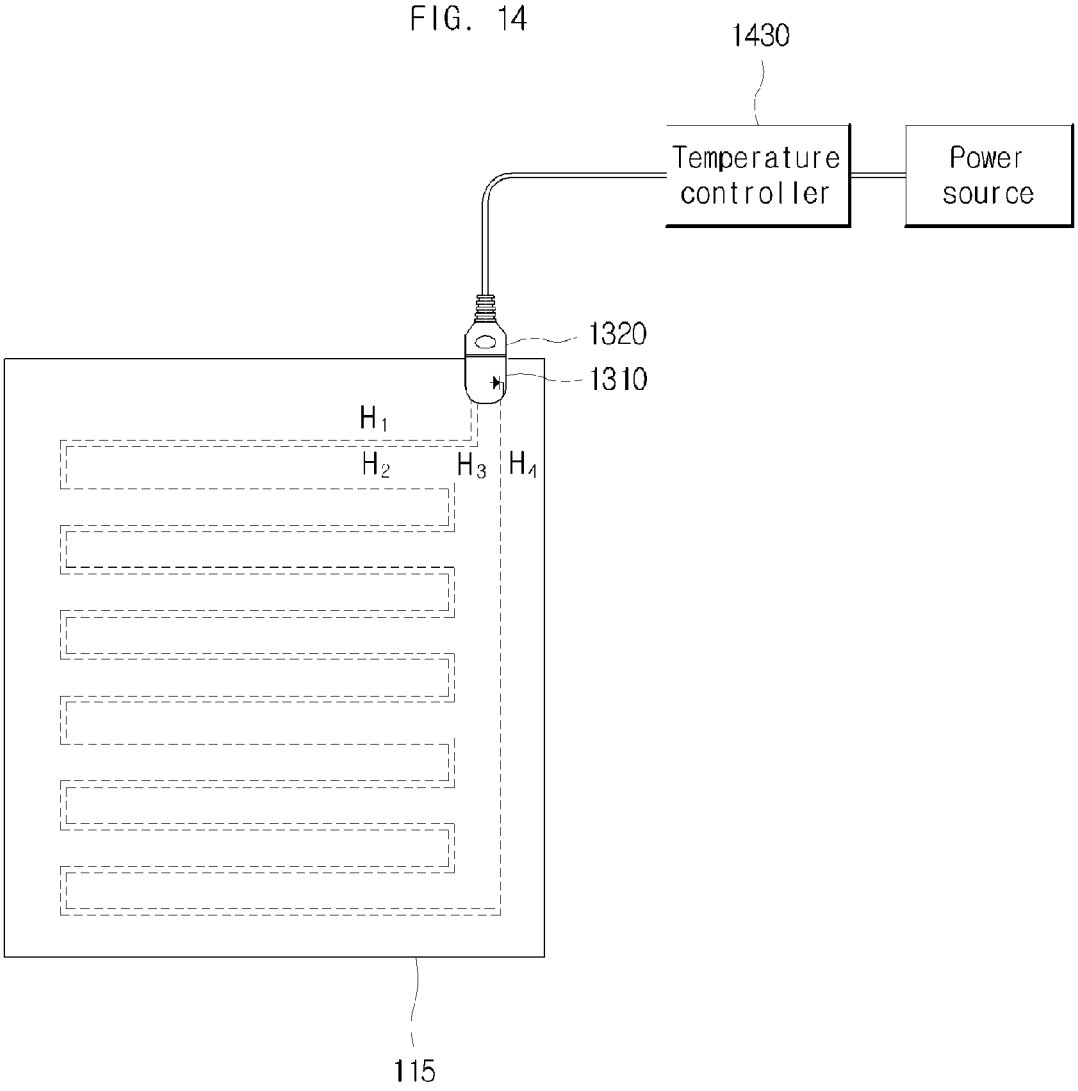
FIG. 14 shows the electric heating cable of an electric mattress pad and the structure of a temperature control device in accordance with the third disclosed embodiment of the present invention.

FIGS. 13 and 14 show the structure of a connection terminal unit 1310 and a temperature controller 1430 employing a circuit of the temperature control device according to the third embodiment of the present invention.

The temperature controller 1430 has a temperature control circuit embedded therein. The temperature control circuit includes the power supply unit 1210, the temperature sensing unit 1220, the signal control unit 1230, the power control unit 1240 and the overheating protection unit 1250 of FIG. 12. Although it is not shown in the accompanying drawings, it shall be apparent that the temperature controller 1430 can further include a display unit and a temperature control knob, etc.

In accordance with an embodiment of the present invention, a connection terminal unit 1310 is installed, as in the example shown in FIG. 13. Here, a connection plug 1320 is remotely connected to a temperature control circuit, which is embedded in the temperature controller 1430, by a power control cable, which is connected to the connection plug 1320. Thus, the temperature can be controlled from a distance.

In this case, the H3 and the H4 shown in FIG. 12 can be installed in the connection terminal unit 1310, as shown in FIG. 13, and a diode D10 can be connected to the connection terminal unit 1310, as shown in FIG. 13. With this arrangement, the temperature controller 1430 is able to supply electric power to the system and control the temperature thereof through the use of only two strands of power control cable, which are connected to the H1 and the H2.

That is, since the temperature control circuit forms a temperature sensing circuit by only using the power control cables of the first and second heating wires, the power supply and the temperature control of the electric heater can be controlled sufficiently by the two power control cables, which connect the connection terminal unit 1310 and the temperature controller 1430 to each other.

In another example, while the connection terminal unit 1310 is connected remotely to the temperature controller 1430 through the power control cables being connected to the connection plug 1320, the diode D10 can be installed in the temperature controller 1430.

In this case, since two additional cables are required to connect the diode D10 to the connection terminal unit 1310 and the temperature controller 1430 of the electric heater, a total of four power control cables is required.

In another example, it may be sometimes required to directly control the temperature from the electric heater, depending on the type of the electric heater. In this case, the connection terminal unit 1310 can be formed in a single unit with the temperature controller 1430, and the single unit can be installed on one corner of the electric heater and then connected to an external power cable.

While the spirit of the present invention has been described in detail with reference to particular embodiments, the embodiments are for illustrative purposes only and shall not limit the present invention. It is to be appreciated that those skilled in the art can change or modify the embodiments without departing from the scope and spirit of the present invention.

What is claimed is:

1. A temperature control device of an electric heater using a thermo-sensitive insulation resin, the temperature control device comprising:

a heating wire, connected to an alternating current power source though a silicon controlled rectifier (SCR);

a sensing wire, disposed parallel to the heating wire;

a thermo-sensitive resin, configured to insulate the heating wire and the sensing wire from each other and change its impedance according to a change in temperature;

a temperature sensing unit, configured to output a temperature control signal to turn the SCR on or off according to a change in electric current flowing through the thermo-sensitive resin, the SCR being turned on or off by a sensing unit diode, wherein the heating wire is heated by a heating current that flows in a heating cycle only, in which a forward voltage is formed in the SCR, by the SCR, and the sensing wire conducts a sensing current that flows in a sensing cycle only, in which a reverse voltage is formed in the SCR, by the sensing unit diode;

a signal control unit, configured to generate an operation control signal to operate the SCR by receiving the temperature control signal of the temperature sensing unit and to delay the operation control signal; and a power control unit, configured to turn the SCR on or off by receiving a signal of the signal control unit, wherein the signal control unit comprises:

a first signal unit transistor, configured to be operated by an output of the first comparator;

a delay node, connected to a first input terminal of a second comparator, the second comparator configured to output an "on" or "off" signal to the SCR;

a first signal unit resistor, connected between a collector of the first signal unit transistor and a direct current voltage source;

a second signal unit resistor, connected between the delay node and the collector of the first signal unit transistor; and a second charging condenser, connected parallel between the delay node and the ground, whereas if the temperature control signal is a command signal to turn the SCR on, a voltage of the first input terminal of the second comparator is delayed for a duration of time, during which an electric current flowing from the direct current voltage source through the first signal unit resistor and the second signal unit resistor is charged into the second charging condenser, according to an operating signal of the first signal unit transistor.

2. A temperature control device of an electric heater using a thermo-sensitive insulation resin, the temperature control device comprising:

a heating wire, connected to an alternating current power source though a silicon controlled rectifier (SCR);

a sensing wire, disposed parallel to the heating wire;

a thermo-sensitive resin, configured to insulate the heating wire and the sensing wire from each other and change its impedance according to a change in temperature;

a temperature sensing unit, configured to output a temperature control signal to turn the SCR on or off according to a change in electric current flowing through the thermo-sensitive resin, the SCR being turned on or off by a sensing unit diode, wherein the heating wire is heated by a heating current that flows in a heating cycle only, in which a forward voltage is formed in the SCR, by the SCR, and the sensing wire conducts a sensing current that flows in a sensing cycle only, in which a reverse voltage is formed in the SCR, by the sensing unit diode;

a signal control unit, configured to generate an operation control signal to operate the SCR by receiving the temperature control signal of the temperature sensing unit and to delay the operation control signal; and a power control unit, configured to turn the SCR on or off by receiving a signal of the signal control unit, wherein the signal control unit comprises:

a first signal unit transistor, configured to be operated by an output of the first comparator;

a delay node, connected to a first input terminal of a second comparator, the second comparator configured to output an "on" or "off" signal to the SCR;

a first signal unit resistor, connected between a collector of the first signal unit transistor and a direct current voltage source;

a second signal unit resistor, connected between the delay node and the collector of the first signal unit transistor; and a first signal unit diode, connected parallel with the second signal unit resistor, whereas if the temperature control signal is a command signal to turn the SCR off, the first signal unit transistor is turned on, and the voltage charged in the second charging condenser is discharged through the first signal unit diode so that the second comparator outputs a command signal to turn the SCR off.

3. A temperature control device of an electric heater using a thermo-sensitive insulation resin, the temperature control device comprising:

a heating wire, connected to an alternating current power source though a silicon controlled rectifier (SCR);

a sensing wire, disposed parallel to the heating wire;

a thermo-sensitive resin, configured to insulate the heating wire and the sensing wire from each other and change its impedance according to a change in temperature;

a temperature sensing unit, configured to output a temperature control signal to turn the SCR on or off according to a change in electric current flowing through the thermo-sensitive resin, the SCR being turned on or off by a sensing unit diode, wherein the heating wire is heated by a heating current that flows in a heating cycle only, in which a forward voltage is formed in the SCR, by the SCR, and the sensing wire conducts a sensing current that flows in a sensing cycle only, in which a reverse voltage is formed in the SCR, by the sensing unit diode;

a signal control unit, configured to generate an operation control signal to operate the SCR by receiving the temperature control signal of the temperature sensing unit and to delay the operation control signal; and a power control unit, configured to turn the SCR on or off by receiving a signal of the signal control unit, wherein the signal control unit comprises:

a first signal unit transistor, configured to be operated by an output of a first comparator;

a delay node, connected to a first input terminal of a second comparator, the second comparator configured to output an "on" or "off" signal to the SCR;

a second control unit diode, connected between the voltage sensing node and a reference voltage input terminal of the second comparator;

a first control unit resistor, connected between a second sensing terminal and the ground; and a second sensing unit resistor, connected between the direct current voltage source and the voltage sensing node, wherein if the sensing wire is broken, the voltage of the reference voltage input terminal of the second comparator is increased above a set reference voltage so that the second comparator outputs a command signal to turn the SCR off.

4. A temperature control device of an electric heater using a thermo-sensitive insulation resin, the temperature control device comprising:

a heating wire, connected to an alternating current power source though a silicon controlled rectifier (SCR);

a sensing wire, disposed parallel to the heating wire;

a thermo-sensitive resin, configured to insulate the heating wire and the sensing wire from each other and change its impedance according to a change in temperature;

a temperature sensing unit, configured to output a temperature control signal to turn the SCR on or off according to a change in electric current flowing through the thermo-sensitive resin, the SCR being turned on or off by a sensing unit diode, wherein the heating wire is heated by a heating current that flows in a heating cycle only, in which a forward voltage is formed in the SCR, by the SCR, and the sensing wire conducts a sensing current that flows in a sensing cycle only, in which a reverse voltage is formed in the SCR, by the sensing unit diode; and an overheating protection unit, in which a circuit with a heating resistor serially connected to an overheating protection unit diode is connected parallel to the SCR such that a temperature fuse connected to a power source can be broken by heating the heating resistor caused by a current flown in the heating resistor when a short-circuit occurs between the heating wire and the sensing wire.

5. A temperature control device of an electric heater using a thermo-sensitive insulation resin, the temperature control device comprising:

a heating wire, connected to an alternating current power source though a silicon controlled rectifier (SCR);

a sensing wire, disposed parallel to the heating wire;

a thermo-sensitive resin, configured to insulate the heating wire and the sensing wire from each other and change its impedance according to a change in temperature; and a temperature sensing unit, configured to output a temperature control signal to turn the SCR on or off according to a change in electric current flowing through the thermo-sensitive resin, the SCR being turned on or off by a sensing unit diode, wherein the heating wire is heated by a heating current that flows in a heating cycle only, in which a forward voltage is formed in the SCR, by the SCR, and the sensing wire conducts a sensing current that flows in a sensing cycle only, in which a reverse voltage is formed in the SCR, by the sensing unit diode, wherein a voltage sensing node is connected to a second power terminal of alternating current, to which ground is connected, through a first charging condenser and is configured to output a voltage to a first input terminal of a first comparator according to a change in temperature, wherein a first sensing unit diode and a first sensing unit resistor are connected in a direction opposite to a forward voltage of the SCR and serially interposed between the voltage sensing node and a first sensing terminal of the sensing wire, and the SCR is connected such that the direction of electric current flowing from a second heating terminal of the heating wire to the ground of the second power terminal becomes a forward direction in a half cycle of the alternating current, and wherein a first comparator is configured to output a temperature control signal to turn the SCR on or off by allowing a voltage of the voltage sensing node, which is charged into the first charging condenser by the sensing current, to be inputted into the first input terminal of the first comparator, whereas the heating current of the alternating current is configured to heat the heating wire by flowing through the first heating terminal→the heating wire→the second heating terminal→the SCR→the ground in the heating cycle, in which a forward voltage is formed in the SCR, and the sensing current reversely flows through the ground→the first charging condenser→the voltage sensing node→the first sensing unit resistor→the first sensing unit diode→the first sensing terminal→the thermo-sensitive insulation resin→the first heating terminal→the first power terminal in the sensing cycle, in which a reverse voltage is formed in the SCR.

6. A temperature control device of an electric heater using a thermo-sensitive insulation resin, the temperature control device comprising:

a heating wire, connected to an alternating current power source though a silicon controlled rectifier (SCR);

a sensing wire, disposed parallel to the heating wire;

a thermo-sensitive resin, configured to insulate the heating wire and the sensing wire from each other and change its impedance according to a change in temperature;

a temperature sensing unit, configured to output a temperature control signal to turn the SCR on or off according to a change in electric current flowing through the thermo-sensitive resin, the SCR being turned on or off by a sensing unit diode, wherein the heating wire is heated by a heating current that flows in a heating cycle only, in which a forward voltage is formed in the SCR, by the SCR, and the sensing wire conducts a sensing current that flows in a sensing cycle only, in which a reverse voltage is formed in the SCR, by the sensing unit diode; and a sleep mode unit configured to switch a circuit such that in a normal mode, only the heating wire is used for a heating load, but in a sleep mode, both the heating wire and the sensing wire are serially connected to each other so that the heating wire and the sensing wire can be used for the heating load.

7. The temperature control device of claim 6, wherein the sleep mode unit comprises a connection switch that switches the circuit to the normal mode or the sleep mode, whereas in the normal mode, the heating wire is connected by the connection switch to the alternating current power source through the SCR, and the sensing wire is connected to the temperature sensing unit, of which a sensing signal controls the SCR, and in the sleep mode, the sensing wire is disconnected by the connection switch from the temperature sensing unit and is serially connected to the heating wire.

8. The temperature control device of claim 6, wherein in the sleep mode, a sleep mode diode is serially connected in the same forward direction as the SCR such that a half wave current always flows even if an electrical connection is formed due to a malfunction of the SCR.

9. A temperature control device of an electric heater using a thermo-sensitive insulation resin, the temperature control device comprising:

a heating wire, connected to an alternating current power source though a silicon controlled rectifier (SCR);

a sensing wire, disposed parallel to the heating wire;

a thermo-sensitive resin, configured to insulate the heating wire and the sensing wire from each other and change its impedance according to a change in temperature; and a temperature sensing unit, configured to output a temperature control signal to turn the SCR on or off according to a change in electric current flowing through the thermo-sensitive resin, the SCR being turned on or off by a sensing unit diode;

wherein the heating wire is heated by a heating current that flows in a heating cycle only, in which a forward voltage is formed in the SCR, by the SCR, and the sensing wire conducts a sensing current that flows in a sensing cycle only, in which a reverse voltage is formed in the SCR, by the sensing unit diode, wherein each one end part of the heating wire and the sensing wire is connected to the alternating current power source, and the other end parts of the heating wire and the sensing wire are connected to each other through a connection unit diode, wherein, in the heating cycle, in which the forward voltage is formed in the connection unit diode and the SCR, a positive (+) side half-wave current of the alternating current power source flows through the heating wire, the connection unit diode and the sensing wire so as to heat the heating wire and the sensing wire so that an external magnetic field is offset by the current flowing in opposite directions, and wherein, in the sensing cycle, in which the reverse voltage is formed in the connection unit diode and the SCR so that the electric current cannot flow through the heating wire and the sensing wire by the connection unit diode and the SCR, a negative (−) side half-wave current of the alternating current power source flows through the thermo-sensitive insulation resin so that the temperature sensing unit senses a change in electric current of the negative (−) side half-wave current flowing through the thermo-sensitive insulation resin and then generates a command signal to turn the SCR on or off.

10. The temperature control device of claim 9, wherein the heating wire is spirally wound on an outer surface of a cord, the sensing wire is spirally wound on an outer surface of the thermo-sensitive insulation resin, and an outer surface of the sensing wire is covered by an insulating material and wherein the thermo-sensitive insulation resin is a nylon thermister.

11. The temperature control device of claim 9, comprising:

a connection terminal unit, formed on one side of the electric heater such that each one end part of the heating wire and the sensing wire is connected to the connection terminal unit; and a temperature controller having a temperature control circuit embedded therein, the temperature controller being remotely connected to the connection terminal unit by a power control cable, wherein the connection terminal unit and the temperature controller are installed on one corner of the electric heater.

12. The temperature control device of claim 9, comprising an overheating protection unit, in which a circuit including a heating resistor serially connected to a Zener diode is connected parallel to the SCR such that a temperature fuse connected to a power source becomes broken by the heating of the heating resistor due to the flowing current in the heating resistor when a voltage exceeding the breakdown voltage is formed in the Zener diode.

13. The temperature control device of claim 9, comprising:

a connection terminal unit, formed on one side of the electric heater such that each one end part of the heating wire and the sensing wire is connected to the connection terminal unit; and a temperature controller having a temperature control circuit embedded therein, the temperature controller being remotely connected to the connection terminal unit by a power control cable, wherein the connection terminal unit is remotely connected to the temperature controller by the power control cable being connected to a connection plug, and the connection unit diode is installed in the connection terminal unit, and the temperature control circuit forms a power supply line and a temperature sensing circuit by only using each one end part of the first and second heating wires so that the temperature controller is connected by only two strands of power cable to the connection terminal unit of the electric heater.

14. A temperature control device of an electric heater using a thermo-sensitive insulation resin, the temperature control device comprising:

a first heating terminal and a second heating terminal, respectively installed on either end of a heating wire;

a sensing wire, disposed parallel to the heating wire, a first sensing terminal and a second sensing terminal respectively being connected to either end of the sensing wire;

a thermo-sensitive resin, configured to insulate the heating wire and the sensing wire from each other and change its impedance according to a change in temperature;

a silicon controlled rectifier (SCR), connected between one of the first and second heating terminals and an alternating current power source;

a voltage sensing node, connected from ground through a first charging condenser to output a voltage to a first input terminal of a first comparator according to a change in temperature, the ground being connected to a second power terminal;

a first sensing unit diode and a first sensing unit resistor, serially interposed between the voltage sensing node and the first sensing terminal and connected in a direction opposite to a forward voltage of the SCR; and a temperature sensing unit, configured to output a temperature control signal controlling the SCR to be turned on or off by the first comparator (U1), wherein the SCR is connected in a forward direction through the heating wire during each half cycle of the alternating current, the forward direction being a direction in which an electric current of the alternating current power source flows to the ground of the second power terminal, and the heating wire is heated by the electric current flowing through the first heating terminal→the heating wire→the second heating terminal→the SCR→the ground in a heating cycle, the heating cycle being a cycle in which a forward voltage is formed in the SCR, and wherein a voltage of the voltage sensing node is inputted into the first input terminal of the first comparator, the voltage of the voltage sensing node being charged into the first charging condenser by a sensing current that reversely flows in a sensing cycle through the ground→the first charging condenser→the voltage sensing node→the first sensing unit resistor→the first sensing unit diode→the first sensing terminal→the thermo-sensitive insulation resin→the first heating terminal→a first power terminal, the sensing cycle being a cycle in which a reverse voltage is formed in the SCR.

15. The temperature control device of claim 14, further comprising:

a signal control unit, configured to generate an operation control signal to operate the SCR by receiving the temperature control signal of the temperature sensing unit and to delay the operation control signal; and a power control unit, configured to turn the SCR on or off by receiving a signal of the signal control unit.

16. The temperature control device of claim 14, comprising an overheating protection unit, wherein the overheating protection unit includes an overheating protection unit diode and a heating resistor, which are serially connected between the ground and an anode of the first sensing unit diode, and a temperature fuse that is serially connected between one terminal of the alternating current power source and one terminal of the heating wire and is installed closely to the heating resistor such that the temperature fuse can block the alternating current power supply when the heating resistor is heated above the set temperature.

17. The temperature control device of claim 14, wherein a voltage of a direct current voltage source is inputted into a second input terminal of the first comparator through a variable resistor, and a set temperature is controlled by the variable resistor.

18. The temperature control device of claim 14, further comprising a sleep mode unit configured to switch the circuit such that in a normal mode, only the heating wire is used for a heating load, but in a sleep mode, both the heating wire and the sensing wire are serially connected to each other so that the heating wire and the sensing wire can be used for the heating load.

* * * * *